US009032629B2

(12) United States Patent
Bermes et al.

(10) Patent No.: US 9,032,629 B2
(45) Date of Patent: May 19, 2015

(54) MONOFILAMENT LINE CUTTING TOOL

(75) Inventors: Steven P. Bermes, Fort Wayne, IN (US); Jay R. Wehrle, Fort Wayne, IN (US)

(73) Assignee: Novae Corporation, Markle, IN (US)

( * ) Notice: Subject to any disclaimer, the term of this patent is extended or adjusted under 35 U.S.C. 154(b) by 474 days.

(21) Appl. No.: 13/430,815

(22) Filed: Mar. 27, 2012

(65) Prior Publication Data

US 2013/0255085 A1 Oct. 3, 2013

(51) Int. Cl.
*B26B 27/00* (2006.01)
*B65H 75/14* (2006.01)

(52) U.S. Cl.
CPC ..... *B26B 27/00* (2013.01); *B65H 75/14* (2013.01); *B65H 2701/313* (2013.01); *B65H 2701/5112* (2013.01); *B65H 2701/52* (2013.01)

(58) Field of Classification Search
CPC ..... B26B 27/00; B65H 2701/313; B65H 3701/5112; B65H 2701/52; B65H 75/14
USPC ..... 30/127; 225/59; 242/129
See application file for complete search history.

(56) References Cited

U.S. PATENT DOCUMENTS

| | | | | |
|---|---|---|---|---|
| 342,532 | A | | 5/1886 | O'Brien |
| 962,285 | A | | 6/1910 | Witt |
| 1,049,874 | A | | 1/1913 | Kramer |
| 1,050,118 | A | | 1/1913 | Farrell |
| 1,489,591 | A | * | 4/1924 | Catlett et al. ..... 242/129 |
| 1,496,228 | A | | 6/1924 | Jones |
| 1,720,502 | A | | 7/1929 | Whelan |
| 2,109,303 | A | | 2/1938 | Ogletree |
| 2,163,064 | A | | 6/1939 | Rominger |
| 2,240,675 | A | | 5/1941 | Seligner |
| 2,533,495 | A | * | 12/1950 | Moffett ..... 242/129 |
| 2,653,776 | A | | 9/1953 | Rochow |
| 2,824,709 | A | * | 2/1958 | Macy ..... 225/44 |
| 3,128,023 | A | * | 4/1964 | Cook ..... 225/19 |
| 3,138,309 | A | * | 6/1964 | Hulterstrum ..... 225/59 |
| 3,201,868 | A | * | 8/1965 | Solly ..... 30/289 |
| 3,757,626 | A | | 9/1973 | Kulp |
| 3,836,059 | A | | 9/1974 | Lauen et al. |
| 3,990,148 | A | | 11/1976 | Rienzo, Sr. |
| 4,053,979 | A | | 10/1977 | Tuthill et al. |
| 4,106,196 | A | * | 8/1978 | Smithline ..... 30/294 |
| 4,111,089 | A | | 9/1978 | Montaruli |
| 4,757,611 | A | * | 7/1988 | Tommi et al. ..... 30/2 |
| 4,802,638 | A | * | 2/1989 | Burger et al. ..... 242/388.1 |
| 4,896,422 | A | * | 1/1990 | Sheehan et al. ..... 30/290 |
| 5,022,577 | A | | 6/1991 | Fike |
| 5,046,253 | A | | 9/1991 | Ireland |
| 5,123,320 | A | | 6/1992 | Hochfeld |

(Continued)

*Primary Examiner* — Hwei C Payer
(74) *Attorney, Agent, or Firm* — George Pappas

(57) ABSTRACT

A monofilament line cutting tool is formed by sandwiching a cutting blade between first and second plastic sheets which are thermally bonded to one another. A monofilament line receiving slot in the plastic sheets extends to the blade whereby monofilament line bent into a U-shape may be placed in contact with the blade cutting edge. The plastic sheets are part of spool forming plastic sheet portions which are thermally bonded to one another and shaped into a spool. The plastic sheets forming the tool are selectively pivotable about a live hinge relative to the spool. The plastic sheets can be separated from one another for forming: a sphere generally around the cutting edge; a pair of elongate barrels extending parallel along each side of the monofilament line receiving slot and adjacent the cutting edge; or, a monofilament line receiving cavity extending to the blade cutting edge.

39 Claims, 33 Drawing Sheets

(56) References Cited

U.S. PATENT DOCUMENTS

| | | | | |
|---|---|---|---|---|
| 5,172,841 | A | 12/1992 | Friedman | |
| 5,182,874 | A | 2/1993 | Powell | |
| 5,359,776 | A | 11/1994 | Glazar | |
| 5,639,506 | A | 6/1997 | Smyth | |
| 5,666,731 | A | 9/1997 | Rungren | |
| 5,718,365 | A | 2/1998 | Palmer | |
| 5,737,842 | A | 4/1998 | Freedman | |
| 5,809,656 | A | 9/1998 | Lindberg | |
| 5,946,997 | A | 9/1999 | Nicholson, Jr. | |
| D422,188 | S | 4/2000 | Lira-Nunez | |
| 6,058,608 | A | 5/2000 | Wruck | |
| 6,096,151 | A | 8/2000 | Edwards et al. | |
| 6,145,427 | A | 11/2000 | Smith | |
| 6,615,495 | B1 | 9/2003 | Evens et al. | |
| 7,305,910 | B1 | 12/2007 | Bermes | |
| D582,745 | S * | 12/2008 | Neiser | D8/98 |
| 7,850,115 | B2 * | 12/2010 | McCall | 242/614 |
| 2013/0255085 | A1 * | 10/2013 | Bermes et al. | 30/124 |
| 2014/0283664 | A1 * | 9/2014 | Blette et al. | 83/650 |

* cited by examiner

MONOFILAMENT LINE CUTTING TOOL

BACKGROUND OF THE INVENTION

1. Field of the Invention

The present invention relates to the field of cutting monofilament line by bending the monofilament line into a U-shape portion and placing the U-shape portion in contact with a cutting blade. More particularly, the present invention relates to an improved monofilament line cutting tool for cutting monofilament line by placing a U-shape portion of the monofilament line in contact with a cutting edge of a cutting blade.

2. Background

The process of cutting monofilament line by bending the monofilament line into a U-shape and placing the tensioned exterior surface of the U-shape portion in contact with a cutting blade cutting edge is known and described in U.S. Pat. No. 7,305,910. A tool for practicing this process is also shown and described therein. That tool is made of plastic by injection molding with the cutting blade being located within a cavity. As shown therein, the tool can be injection molded and formed as part of a monofilament line retaining spool. The tool cavity is adapted to receive the bent U-shape portion of the monofilament line whereby the monofilament line may be placed in contact with the cutting blade cutting edge.

Although the prior monofilament line cutting tools serve their purpose well, there is a need for a monofilament line cutting tool structure which can be easily and less expensively manufactured, especially and preferably integrally with a spool whereupon monofilament line may be wrapped and stored and then withdrawn in smaller desired lengths.

SUMMARY OF THE INVENTION

In one form thereof the present invention is directed to a monofilament line cutting tool including a cutting blade having a cutting edge, a first plastic sheet and a second plastic sheet bonded to the first plastic sheet. The cutting blade is sandwiched between and securely retained between the first and second plastic sheets. A monofilament line receiving slot in the first and second plastic sheets extends to the blade cutting edge, whereby monofilament line may be cut by bending into a U-shape and inserting the U-shape into the slot and contacting the blade cutting edge.

Preferably, the first and second plastic sheets are shaped and bonded to one another also forming a spool for wrapping monofilament line thereon. More particularly, the first and second plastic sheets are each part of respective first and second spool forming plastic sheet portions and the first and second spool forming plastic sheet portions are shaped and adhered to one another forming a spool for wrapping monofilament line thereon. A live hinge is provided between the first and second plastic sheets and the first and second spool forming plastic sheet portions whereby the first and second plastic sheets are selectively pivotable about the hinge relative to the spool. Preferably, the plastic sheets are thermally formable and are thermally shaped and are bonded to one another by thermal welding.

In one embodiment, the cutting blade is planar shaped and the cutting blade and the first and second plastic sheets are in planes parallel to one another. The first and second plastic sheets can include half sphere shaped projections adjacent the cutting blade cutting edge which together form a sphere generally around the cutting blade cutting edge. That is, the first and second plastic sheets are separated from one another for together forming a sphere or other three dimensional shapes generally around the cutting blade cutting edge. Alternatively, the first and second plastic sheets can be separated from one another for forming a pair of elongate barrels with the elongate slot extending generally parallel therebetween and the cutting blade cutting edge extending generally perpendicular therebetween. The elongate barrels can be part of a U-shaped cylinder. That is, the first and second plastic sheets can include respective mirror shaped U-shaped projections which together form a U-shaped cylinder. The legs of the U-shaped cylinder form a pair of elongate barrels with the elongate slot extending generally parallel therebetween and the cutting blade cutting edge extending generally perpendicular therebetween.

In another embodiment, the first and second plastic sheets are separated from one another in an area adjacent the blade for thereby forming a monofilament line receiving cavity extending to the blade cutting edge. The cutting blade is planar shaped and is located generally perpendicular to the first and second plastic sheets. Monofilament line may be cut by bending into a U-shape and inserting the U-shape into the cavity and contacting the blade cutting edge. A flap may be provided integrally formed with and hingedly secured to one of the first or second plastic sheets. The flap extends into the cavity and is moveable about the hinge by inserting the monofilament line U-shape into the cavity and slidingly pushing the U-shape against the flap.

More preferably, the flap is integrally formed with and hingedly secured to one of the first or second plastic sheets along a hinge axis and extends into the cavity. The cutting blade is planar shaped and is located generally perpendicular to the flap hinge axis. The flap is normally in a closed position obstructing access to the cutting blade cutting edge from a cavity opening. For accessing the cutting edge, the flap is moveable about the hinge axis in a direction generally parallel to the blade cutting edge toward an open position by inserting the monofilament line U-shape into the cavity and thereby slidingly pushing the U-shape against the flap. The flap includes a blade receiving slot, and the blade extends through the flap blade receiving slot. The flap may include a bent terminal end bearing against one of the first or second plastic sheets and forming a spring whereby the flap is maintained in its normally closed position.

Yet more preferably, a first flap is provided and is integrally formed with and hingedly secured to the first plastic sheet along a first hinge axis. A second flap is provided and is integrally formed with and hingedly secured to the second plastic sheet along a second hinge axis. Both the first and second flaps extend into the cavity. The cutting blade is planar shaped and is located generally perpendicular to the flap hinge axes. The flaps are normally in a closed position obstructing access to the cutting blade cutting edge from a cavity opening. For accessing the cutting edge, the flaps are moveable about their respective hinge axes in a direction generally parallel to the blade cutting edge toward open positions by inserting the monofilament line U-shape into the cavity and thereby slidingly pushing the U-shape against the flaps. The flaps each include a blade receiving slot, and the blade extends through the flap blade receiving slots. The first flap includes a bent terminal end bearing against the first plastic sheet and forming a spring whereby the first flap is maintained in its normally closed position, and the second flap includes a bent terminal end bearing against the second plastic sheet and forming a spring whereby the second flap is maintained in its normally closed position.

In all of the embodiments, preferably, the first and second plastic sheets are shaped and bonded to one another also forming a spool for wrapping monofilament line thereon.

More particularly, the first and second plastic sheets are each part of respective first and second spool forming plastic sheet portions and the first and second spool forming plastic sheet portions are shaped and adhered to one another forming a spool for wrapping monofilament line thereon. A live hinge is provided between the first and second plastic sheets and the first and second spool forming plastic sheet portions whereby the first and second plastic sheets are selectively pivotable about the hinge relative to the spool. Preferably, the plastic sheets are thermally formable and are thermally shaped and are bonded to one another by thermal welding.

BRIEF DESCRIPTION OF THE DRAWINGS

The above mentioned and other features of this invention, and the manner of attaining them, will become more apparent and the invention itself will be better understood by reference to the following description of the embodiments of the invention taken in conjunction with the accompanying drawings, wherein.

Figure 1:
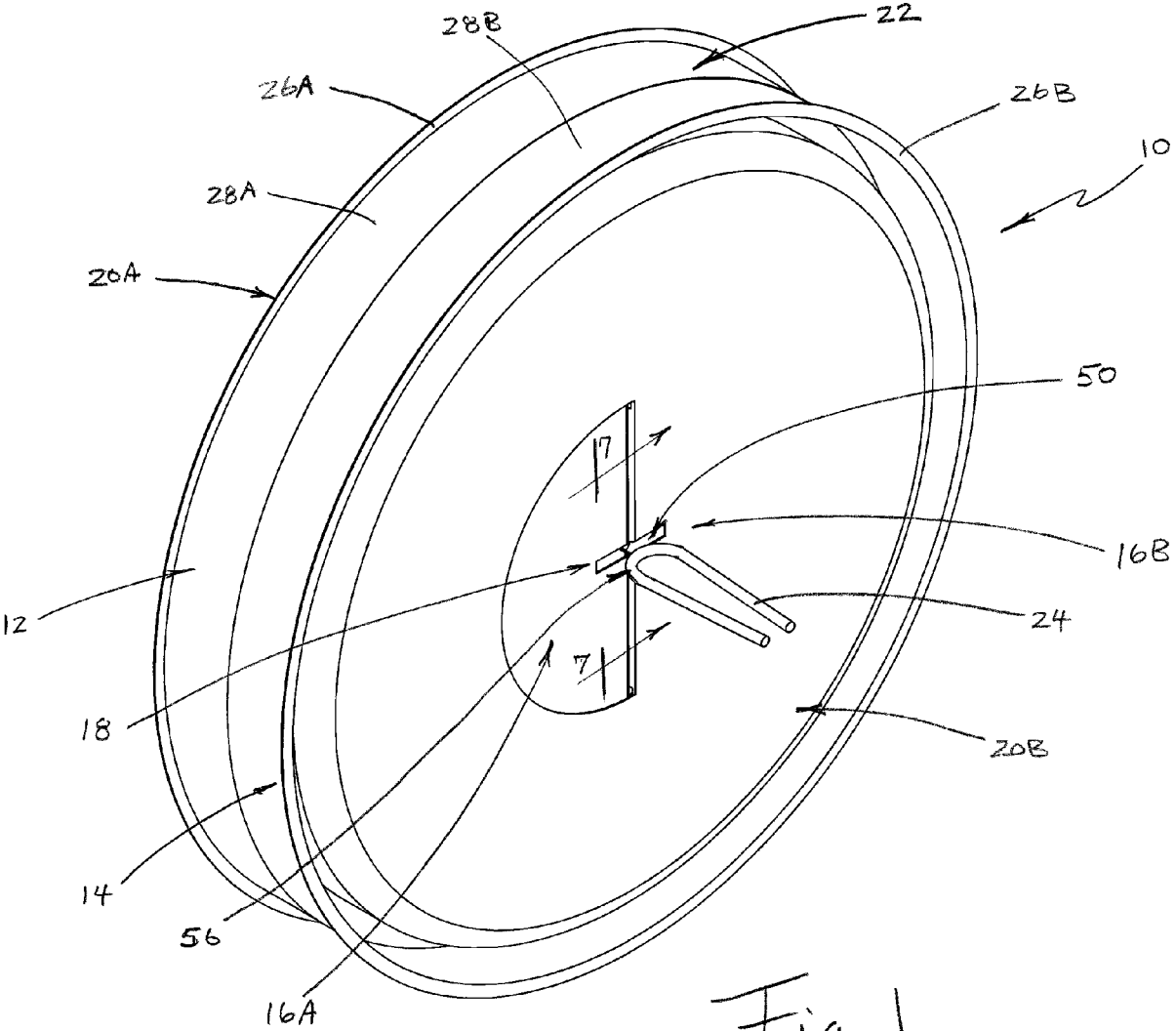
FIG. 1 is a perspective view of a monofilament line cutting tool constructed in accordance with the principles of the present invention and incorporated in a monofilament line retaining spool.

Corresponding reference characters indicate corresponding parts throughout several views. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION OF THE PREFERRED EMBODIMENTS

A monofilament line cutting tool and spool assembly is shown and generally designated in the several figures by the numeral 10. Assembly 10 is constructed with two spool halves or sections 12, 14 which are thermally bonded/welded/adhered to one another. Spool halves 12, 14 are made from thermally formable flat/planar plastic sheets which can be shaped as desired, for example, by heating and vacuum forming in a known and customary manner. The flat plastic sheets are available in various thicknesses, colors, grades, etc. In the preferred embodiments described herein, the flat plastic sheets are typically thinner than 3/32 inch, although thicker sheets can be used as well.

In each of the described embodiments, as more fully described herein below, the central plastic sheet portions 16A, 16B of spool halves 12, 14 respectively form a monofilament line cutting tool 18. The outer plastic sheet portions 20A, 20B of spool halves 12, 14 respectively form a spool 22 for wrapping and retaining monofilament line 24 therearound (not shown on the spool). Spool 22 is defined by the annular walls 26A, 26B and the cylindrical spool bottom sections 28A, 28B.

Additionally, in each of the described embodiments, the central plastic sheet portions 16A and the outer plastic sheet portions 20A are integral with one another/are cut from the same sheet of flat plastic sheet stock and are simultaneously cut, heated and vacuum formed into their respective desired shapes. Similarly, the central plastic sheet portions 16B and the outer plastic sheet portions 20B are integral with one another/are cut from the same sheet of flat plastic sheet stock and are simultaneously cut, heated and vacuum formed into their respective desired shapes. By bonding the spool halves 12, 14 to one another and sandwiching a cutting blade 30 between the central plastic sheet portions 16A, 16B, the assembly 10 is relatively easily and inexpensively manufactured and includes both a spool 22 and a monofilament line cutting tool 18. Hence, in use, monofilament line can be removed from the spool 22 and selectively cut to desired lengths using the cutting tool 18.

In the embodiment of FIGS. 1-7, the central sheet portion 16A of spool half 12 is cut along an arc 33A and bent along bend line 34A for thereby defining appendage sheet 36A and face sheet 38A. A slot 40A is cut through the central sheet portion 16A and extends perpendicular to and on both sides of the bend line 34A through the appendage sheet 36A and the face sheet 38A. Similarly, central sheet portion 16B of spool half 14 is cut along an arc 33B and bent along bend line 34B for thereby defining appendage sheet 36B and face sheet 38B. A slot 40B is cut through the central sheet portion 16B and extends perpendicular to and on both sides of the bend line 34B through the appendage sheet 36B and the face sheet 38B.

Figure 2:
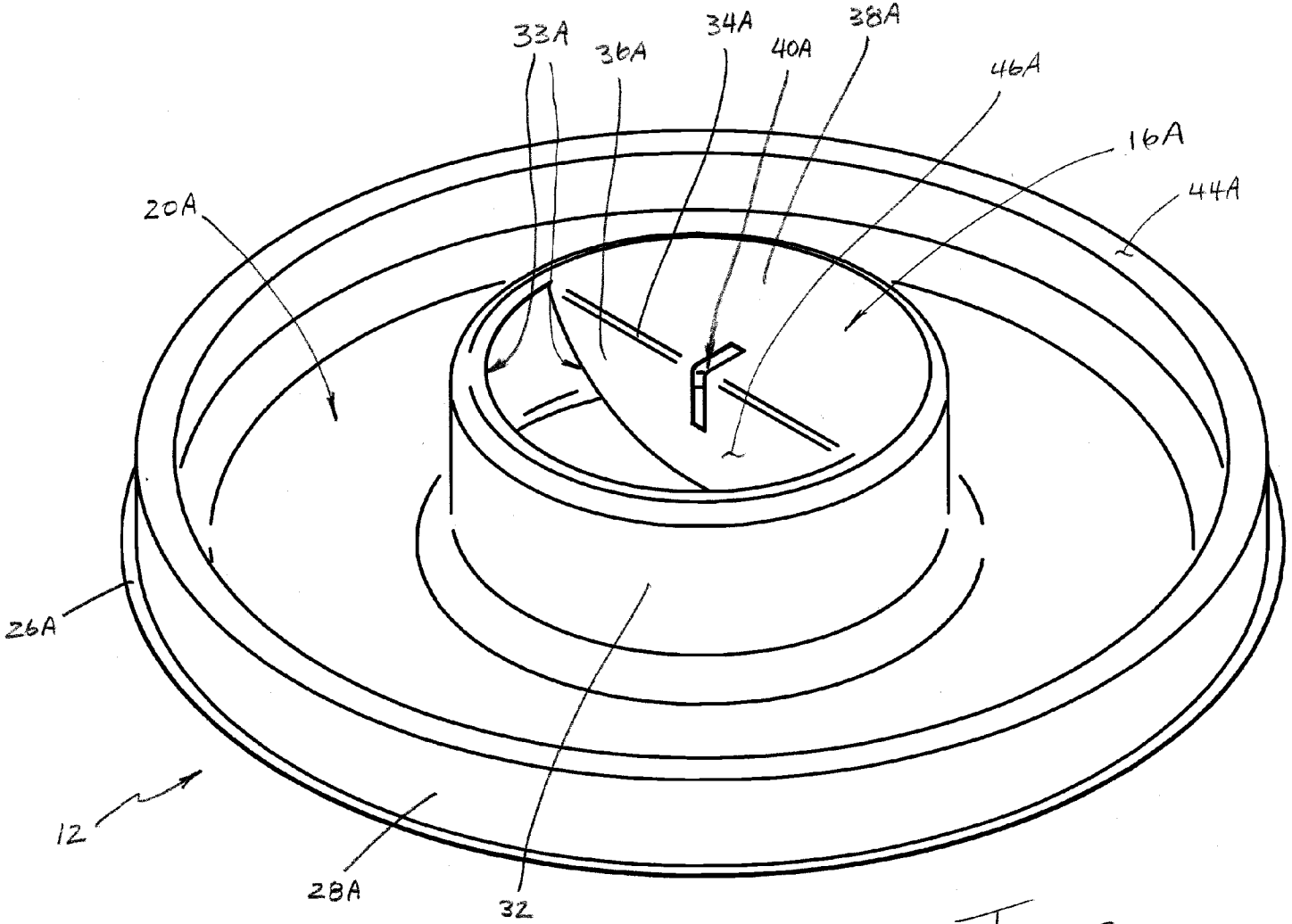
FIG. 2 is a perspective view of one half section of the cutting tool and spool shown in FIG. 1.
Figure 3:
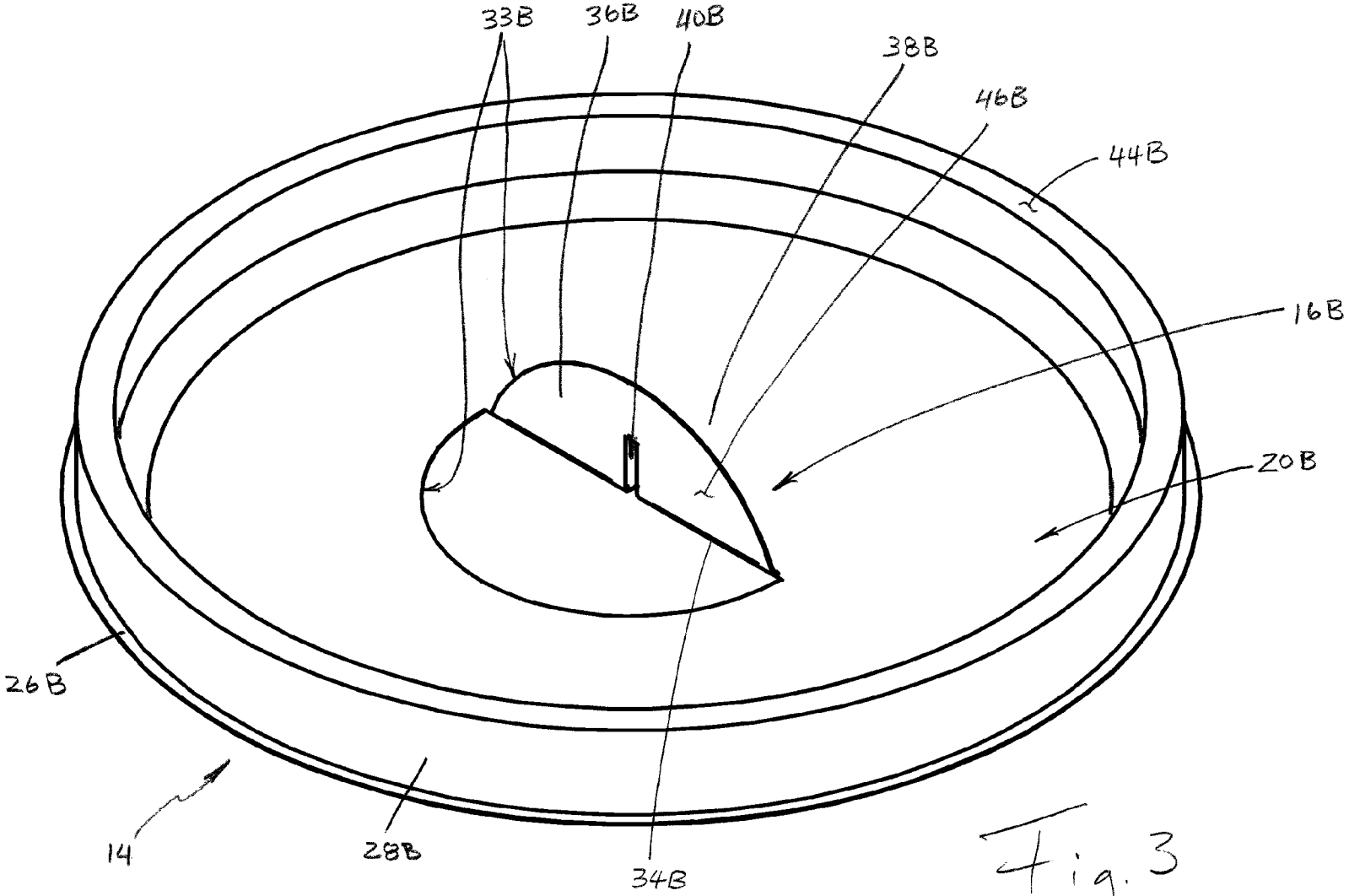
FIG. 3 is a perspective view of the other half section of the cutting tool and spool shown in FIG. 1.
Figure 4:
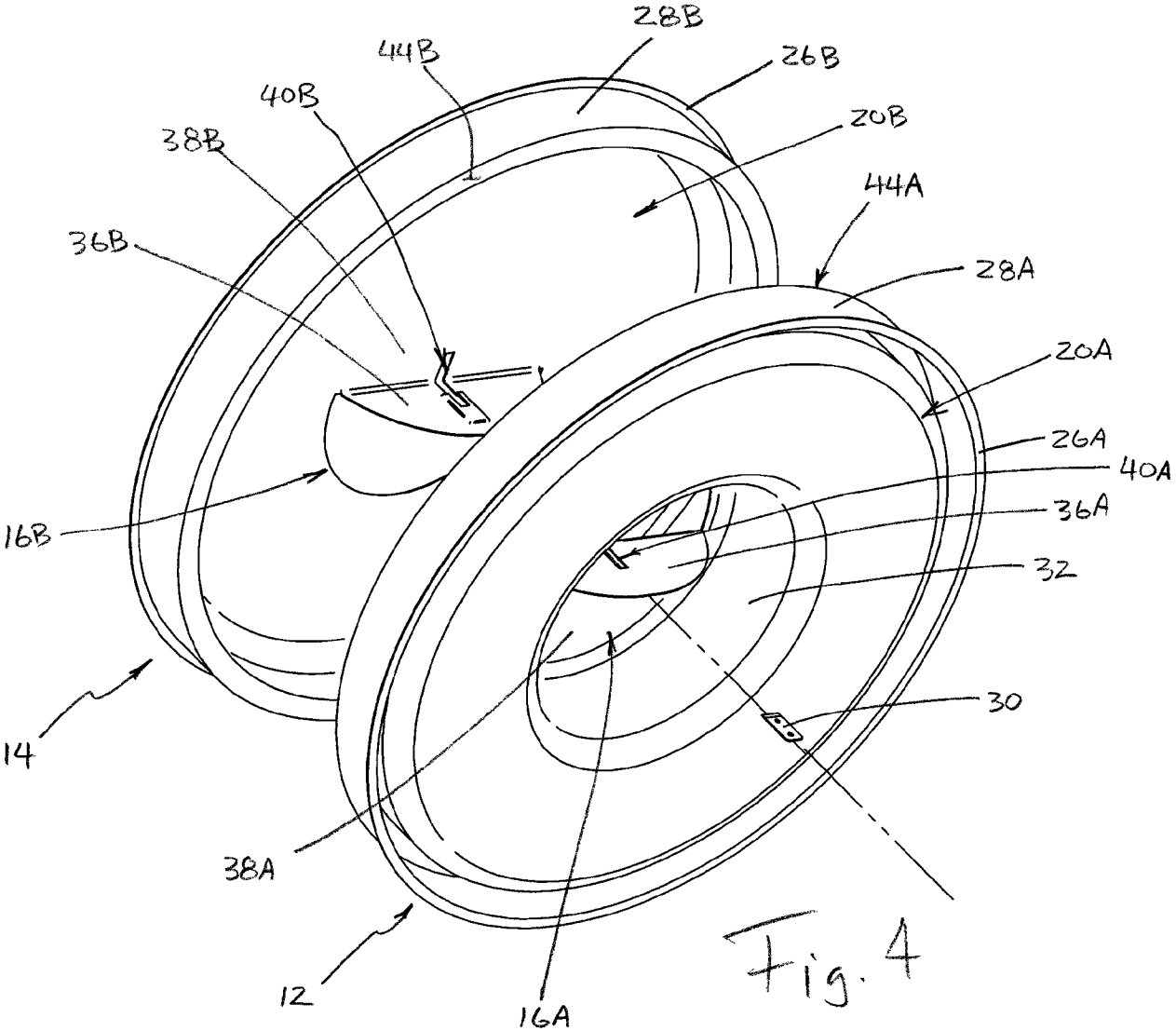
FIG. 4 is a perspective exploded view of the two half sections shown in FIGS. 2 and 3 and a cutting blade.
Figure 5:
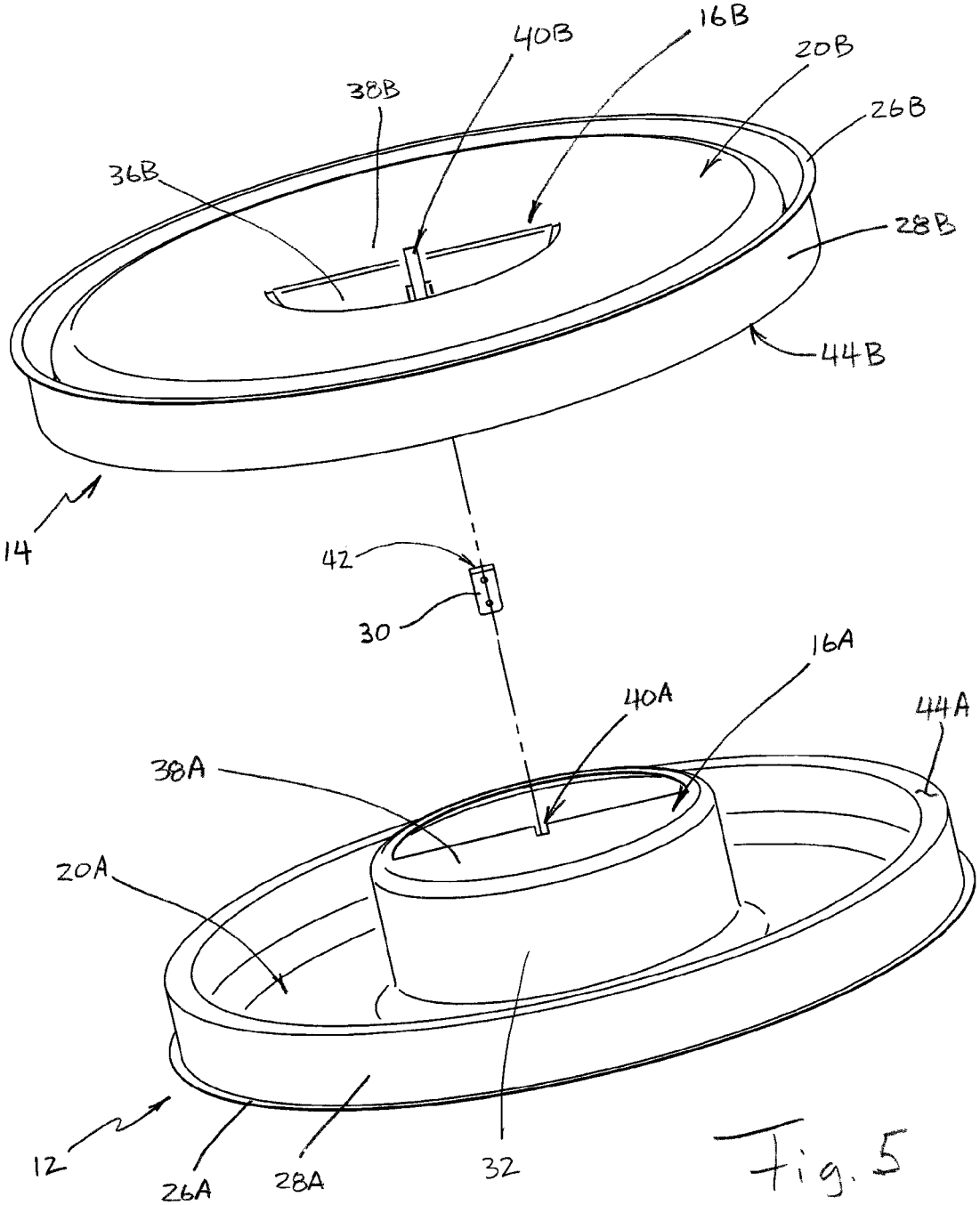
FIG. 5 is another perspective exploded view of the two half sections shown in FIGS. 2 and 3 and a cutting blade.
Figure 6:
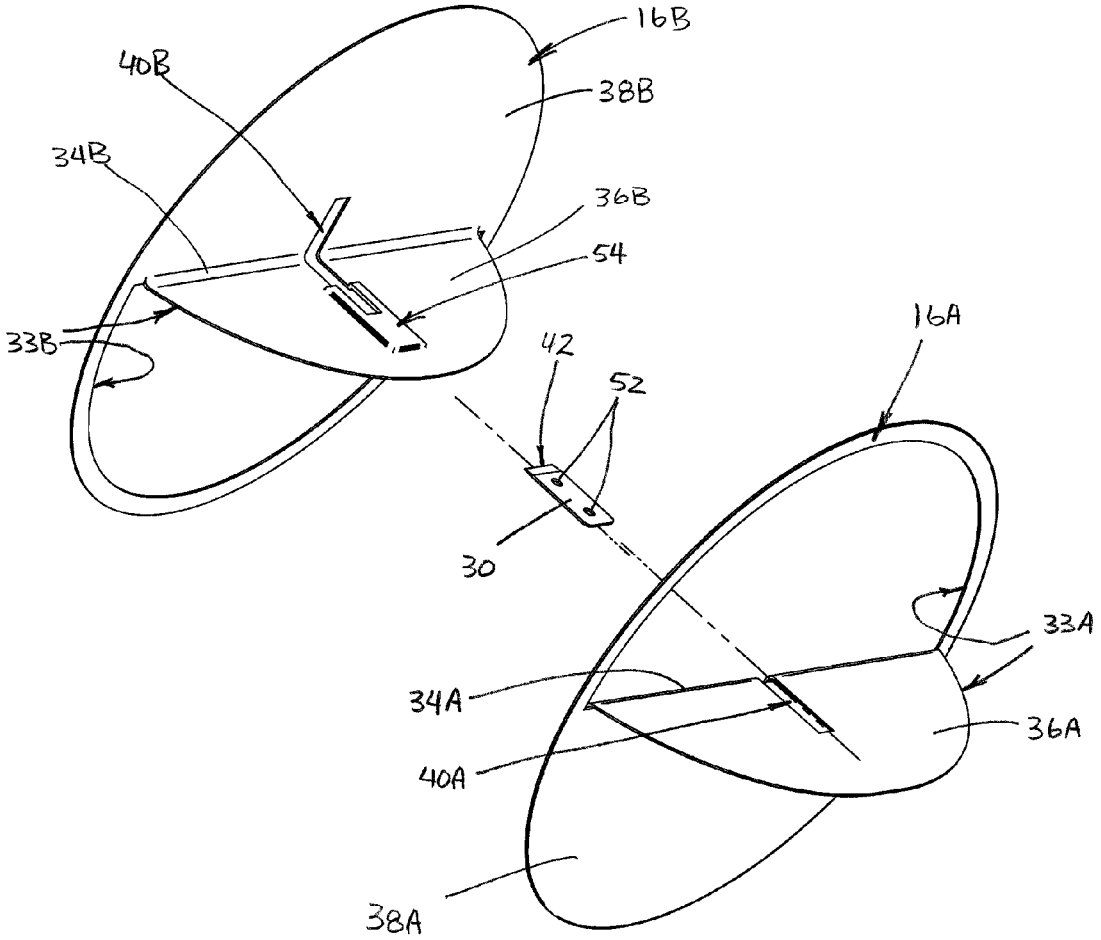
FIG. 6 is an enlarged perspective exploded view of the center area of the spool shown in FIG. 1 and a cutting blade.
Figure 7:
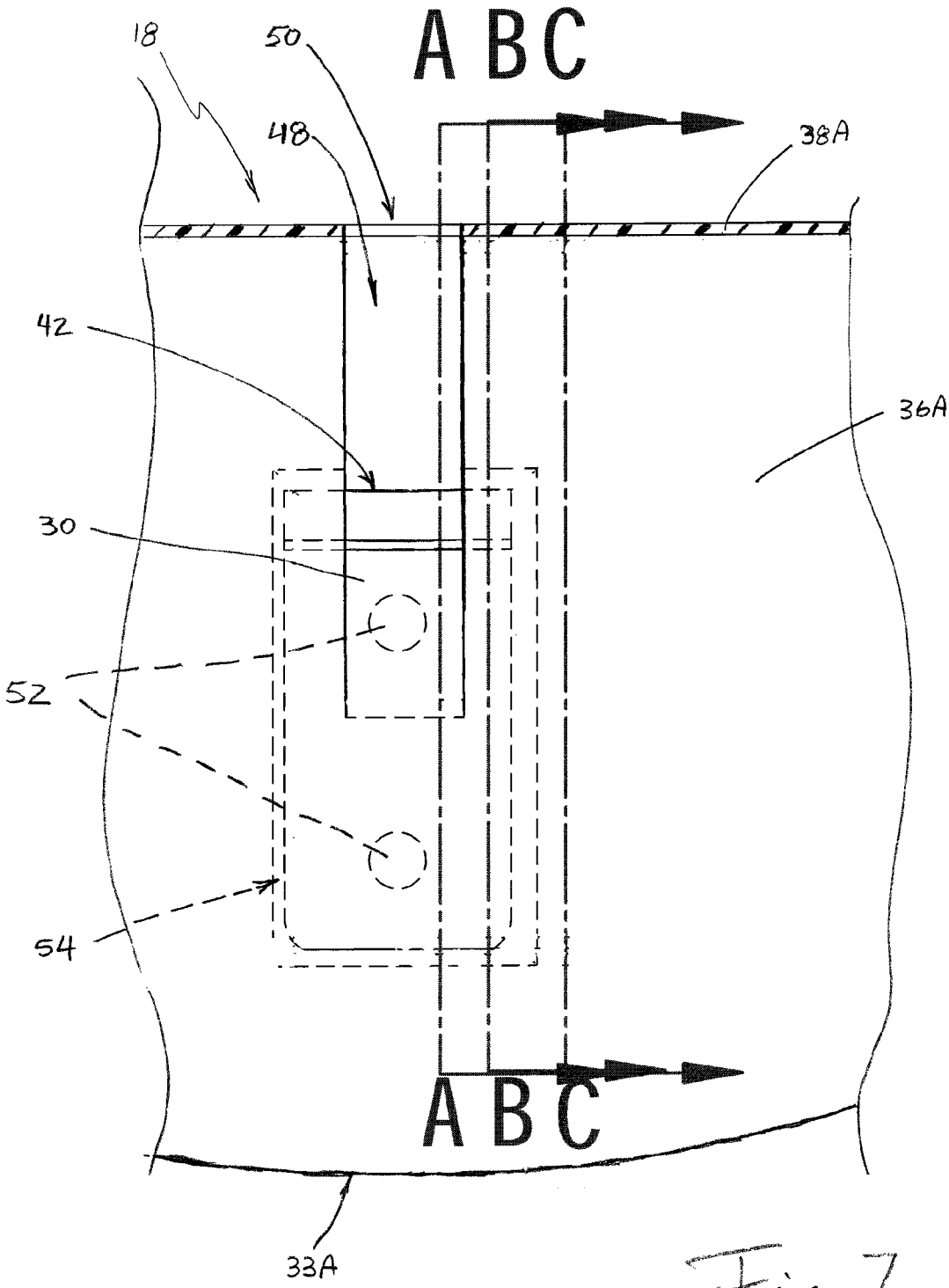
FIG. 7 is a cross-sectional view taken along line 7-7 of FIG. 1.
Figure 7A:
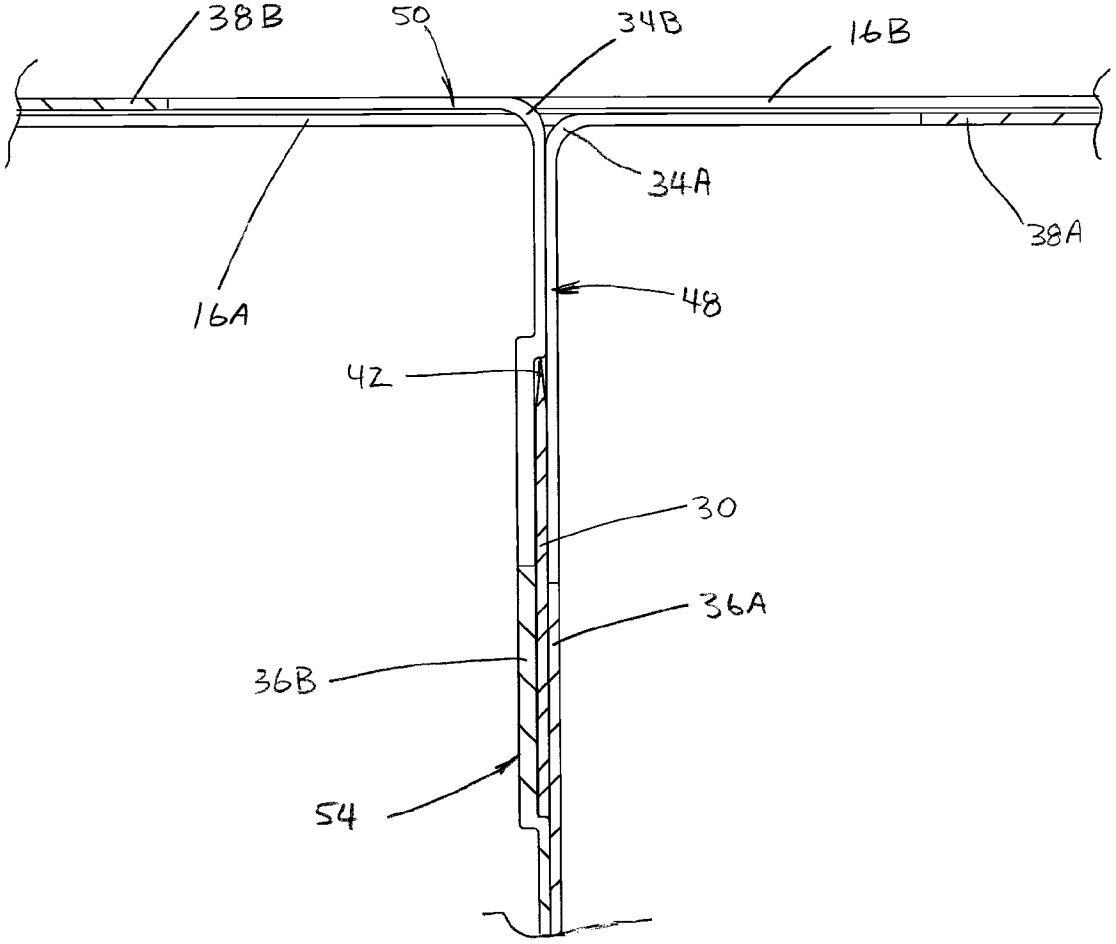
FIG. 7A is a cross-sectional view taken along line A-A of FIG. 7.
Figure 7B:
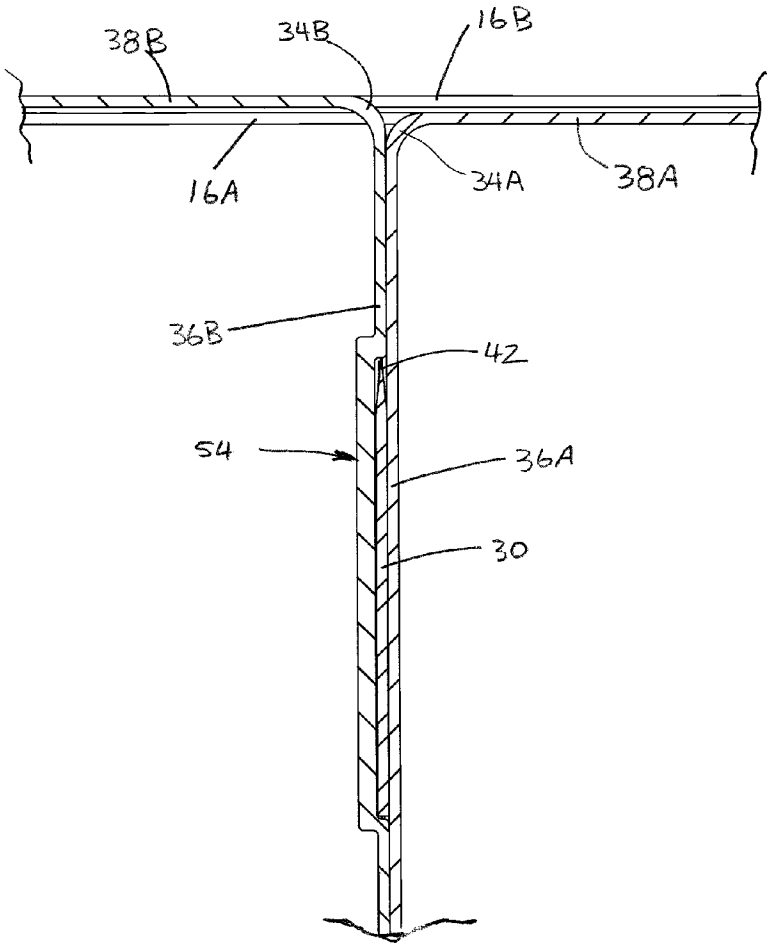
FIG. 7B is a cross-sectional view taken along line B-B of FIG. 7.
Figure 7C:
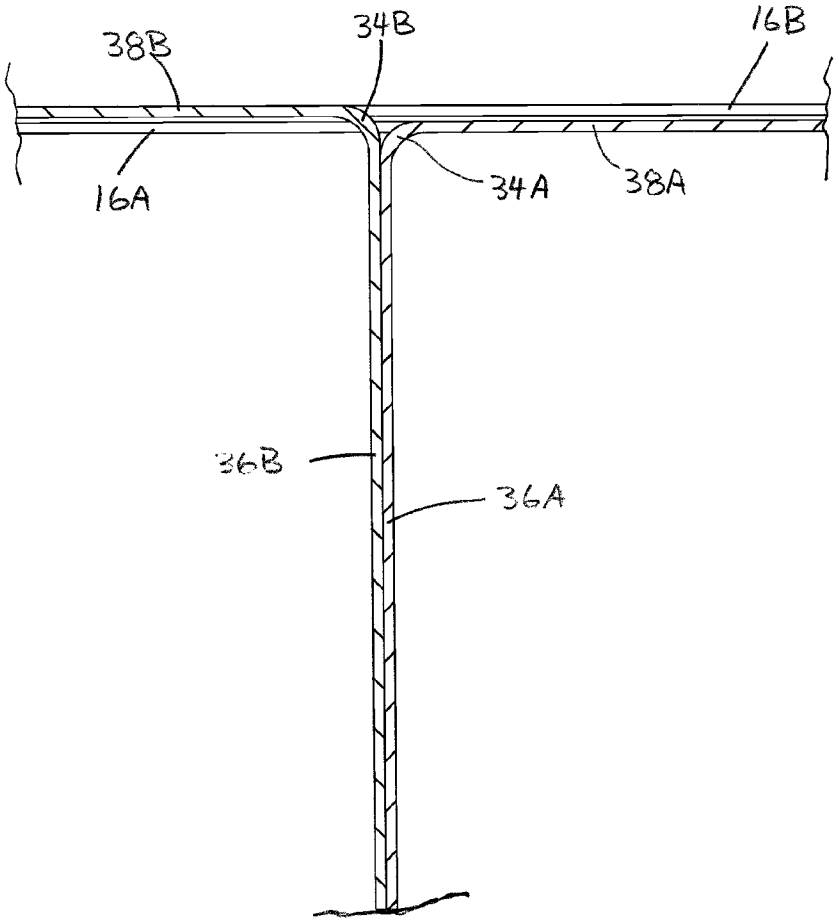
FIG. 7C is a cross-sectional view taken along line C-C of FIG. 7.
Figure 8:
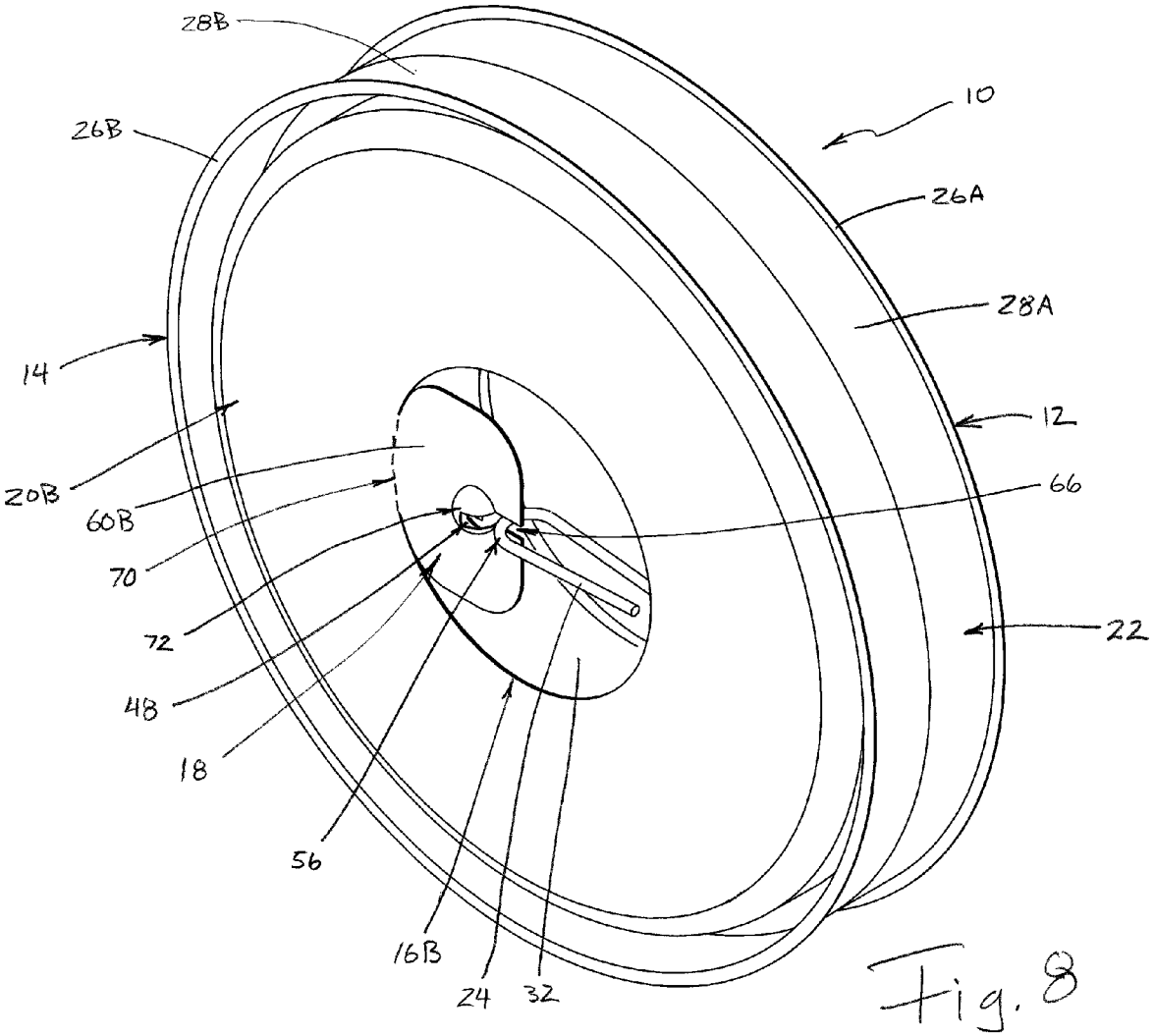
FIG. 8 is a is a perspective view of another embodiment of a monofilament line cutting tool constructed in accordance with the principles of the present invention and incorporated in a monofilament line retaining spool.
Figure 9:
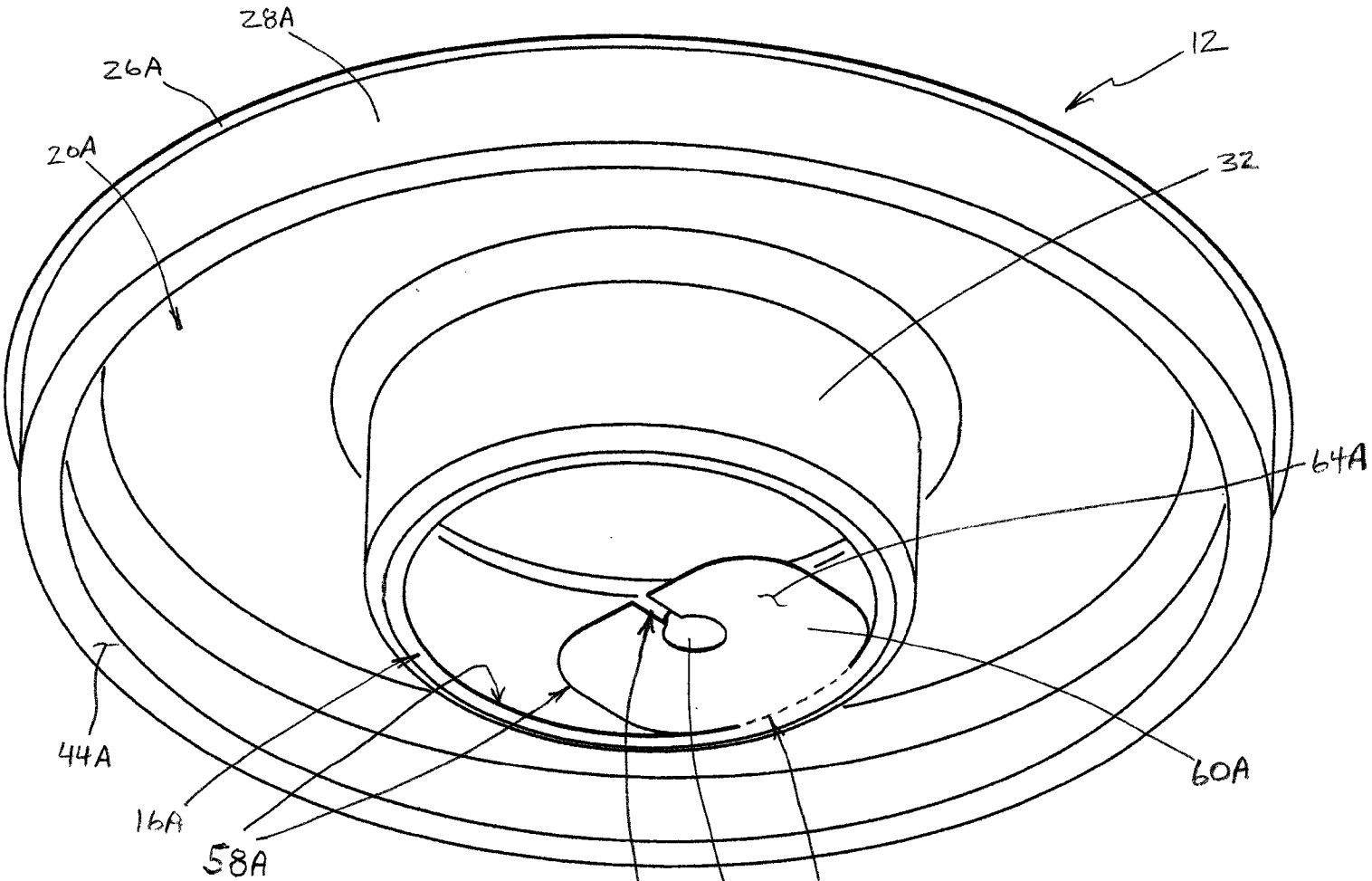
FIG. 9 is a perspective view of one half section of the cutting tool and spool shown in FIG. 8.
Figure 10:
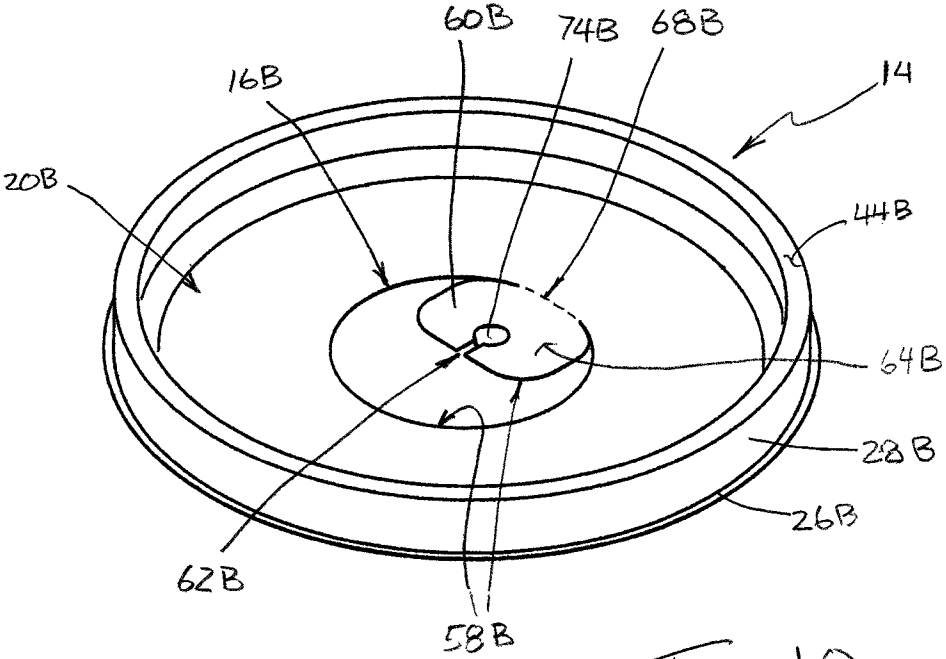
FIG. 10 is a perspective view of the other half section of the cutting tool and spool shown in FIG. 8.
Figure 11:
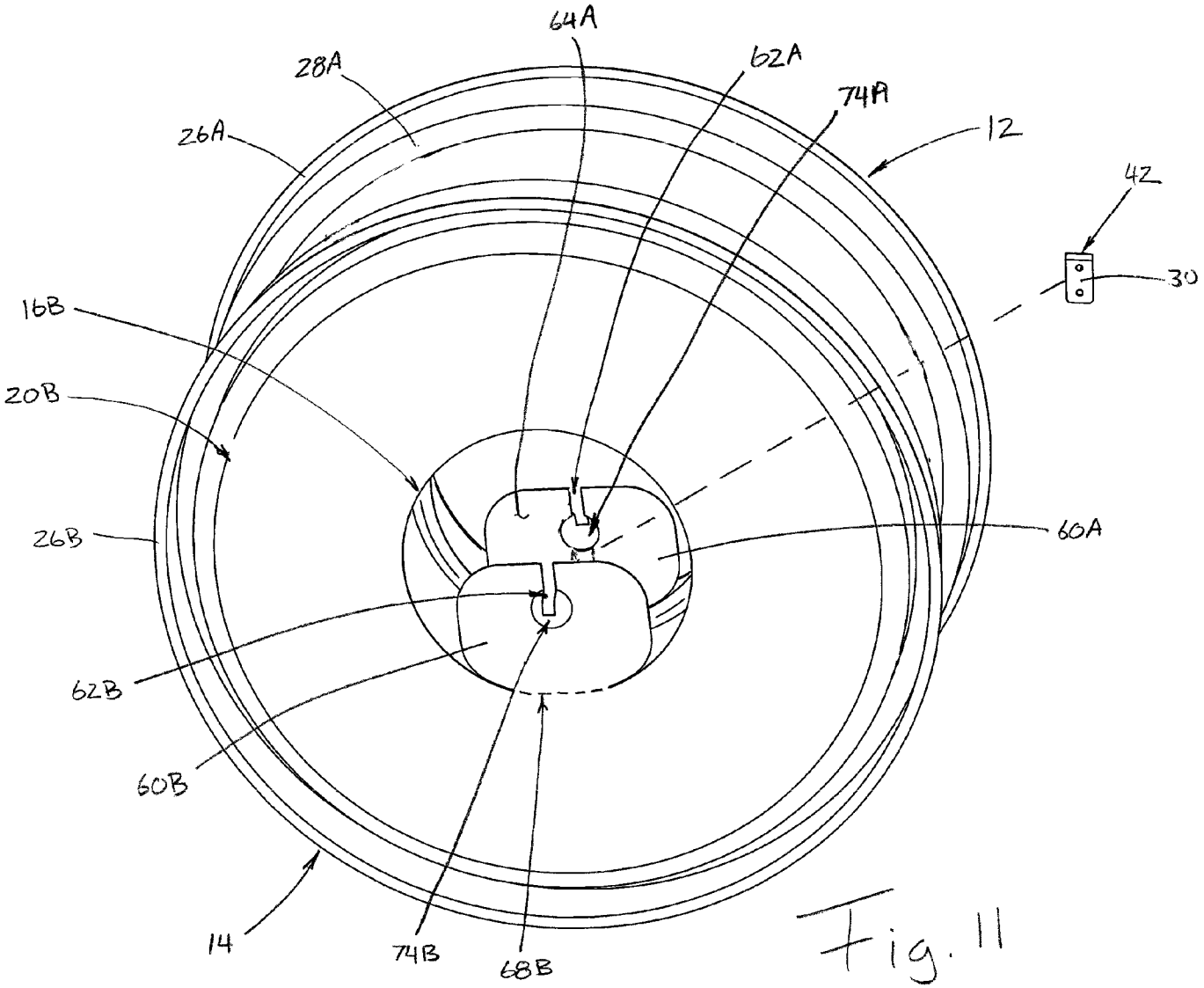
FIG. 11 is a perspective exploded view of the two half sections shown in FIGS. 9 and 10 and a cutting blade.

As best seen in FIG. 2, the central sheet portion 16A of spool half 12 is axially offset toward the central sheet portion 16B of spool half 14 with a cylindrical standoff 32 for thereby locating face sheet 38A generally/approximately coplanar with face sheet 38B and locating appendage sheet 36A adjacent and parallel to appendage sheet 36B. When joining the spool halves 12, 14 to form assembly 10, the annular surface 44A of spool half 12 is placed adjacent to and thermally bonded to annular surface 44B of spool half 14. Also, appendage surfaces 46A, 46B of respective appendage sheets 36A, 36B are bonded to one another with cutting blade 30 sandwiched therebetween for thereby locating and securely retaining the cutting blade 30 as needed for use in the cutting tool 18.

After joining halves 12 and 14, slots 40A, 40B in the appendage sheets 36A, 36B are aligned to one another and form a monofilament line receiving slot 48 which is coplanar with the appendage sheets 36A, 36B and perpendicular to the bend lines 34A, 34B. Monofilament line receiving slot 48 is also generally perpendicular to the face sheets 38A, 38B. Slots 40A, 40B in the face sheets 38A, 38B become collinear and form a monofilament line cutting tool opening 50 which is perpendicular to the bend lines 34A, 34B and generally perpendicular to the monofilament line receiving slot 48. Monofilament line cutting tool opening 50 is coplanar with face sheets 38A, 38B.

The cutting blade 30 is flat/planar shaped and includes a cutting edge 42 and engagement holes 52. Blade 30 is made of hardened steel, ceramics, or any other suitable material whereby a sharp cutting edge 42 may be formed. A pocket 54 is preferably thermally formed in the appendage 36B corresponding to and adapted to receive the cutting blade 30. Pocket 54 essentially accommodates the thickness of blade 30. During assembly and the bonding of spool halves 12, 14 and the appendages 36A, 36B, blade 30 is located in pocket 54 and is sandwiched and thermally bonded between the appendages 36A, 36B. Accordingly, after assembly, blade 30 is generally parallel with the appendages 36A, 36B and is securely retained with its cutting edge 42 generally perpendicular to the monofilament line receiving slot 48.

In operation and use of the embodiment shown in FIGS. 1-7, monofilament line 24 from spool 22 or another source can be cut by bending into a U-shape 56 and inserting through the cutting tool opening 50 and into the receiving slot 48 whereat it contacts the blade cutting edge 42.

The embodiment of FIGS. 8-13 is substantially similar to the embodiment of FIGS. 1-7 except that the central plastic sheet portions 16A, 16B are cut along pattern lines 58A, 58B for forming appendages 60A, 60B, each with a respective slot 62A, 62B. The spool halves 12, 14 are similarly joined to form a spool 22 by thermally bonding their respective annular surfaces 44A, 44B to one another. Here, appendage surfaces 64A, 64B are bonded to one another with cutting blade 30 sandwiched therebetween thereby locating and securely retaining the cutting blade 30 as needed for use in the cutting tool 18. With the plastic sheets surfaces 64A, 64B of appendages 60A, 60B bonded together, their respective slots 62A, 62B form a monofilament line receiving slot 48 with an opening 66.

Live hinge score lines 68A, 68B shown in dash line in FIGS. 8-13 are provided between the central plastic sheet portions 16A, 16B and the outer plastic sheet portions. When appendages 60A, 60B are bonded to one another, score lines 68A, 68B are aligned with one another and form a live hinge 70 between the monofilament line cutting tool 18 and the spool 22. The appendages 60A and 60B and the formed cutting tool 18 are thus selectively pivotable about the live hinge 70 relative to the spool 22.

Figure 12:
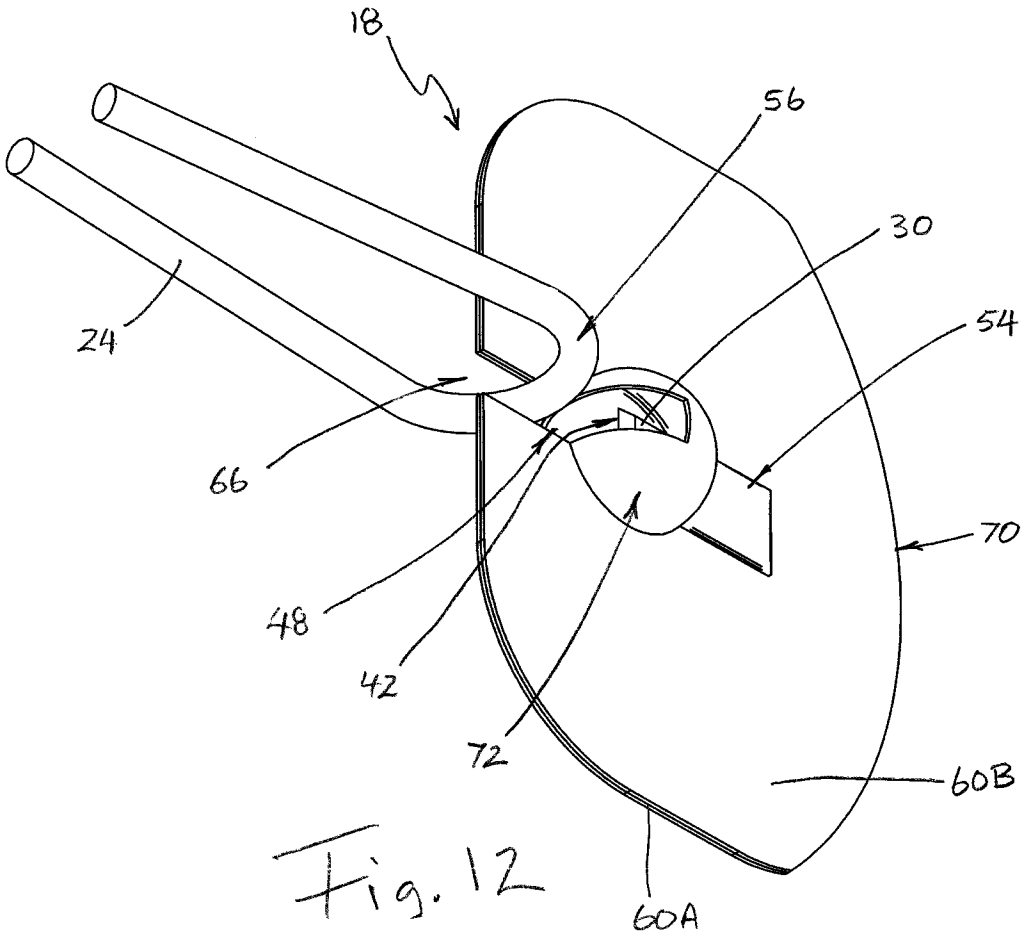
FIG. 12 is an enlarged perspective view of the center area of the spool shown in FIG. 8 and showing the cutting tool.
Figure 13:
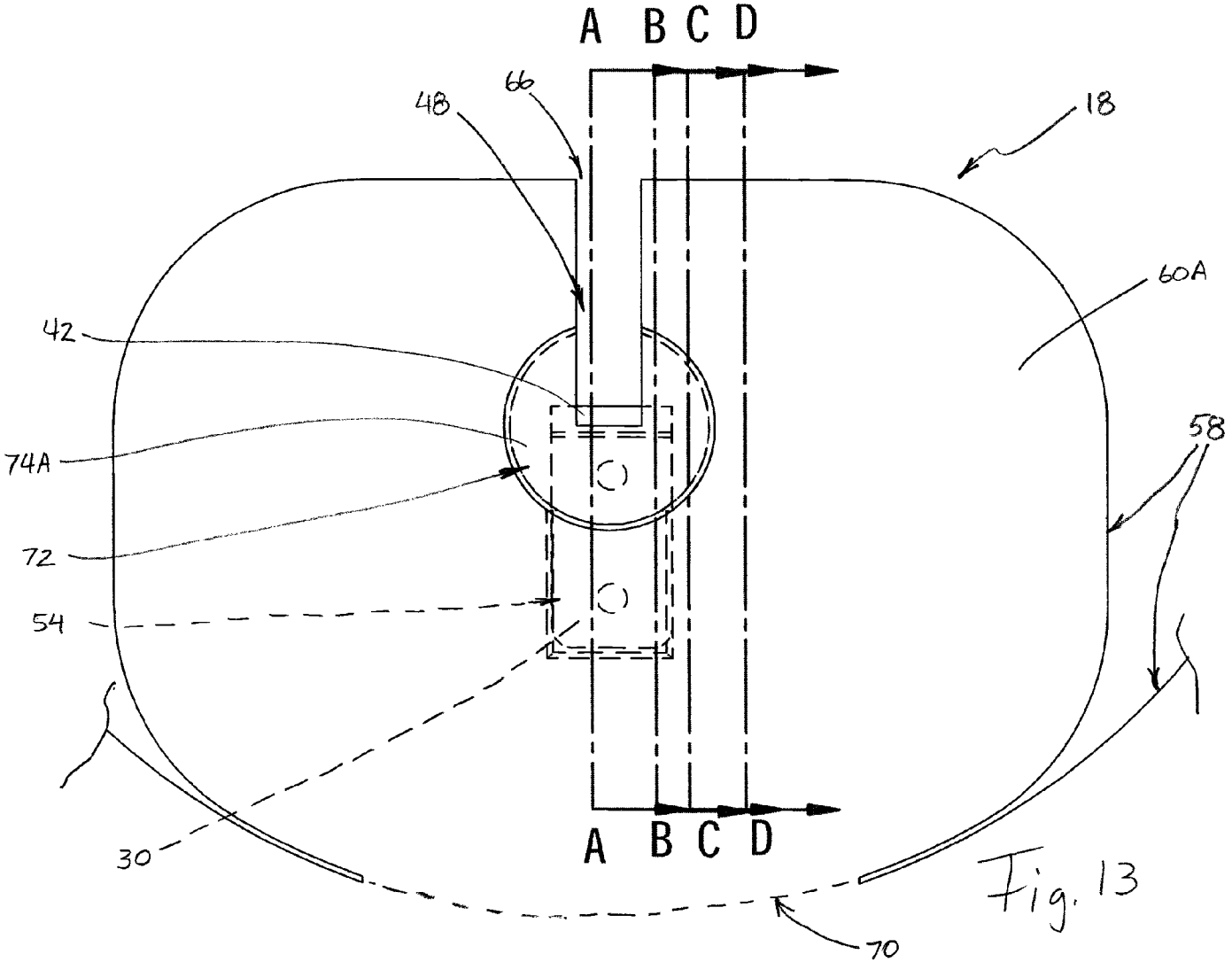
FIG. 13 is an enlarged side elevation view of the center area of the spool shown in FIG. 8 and showing the cutting tool.
Figure 13A:
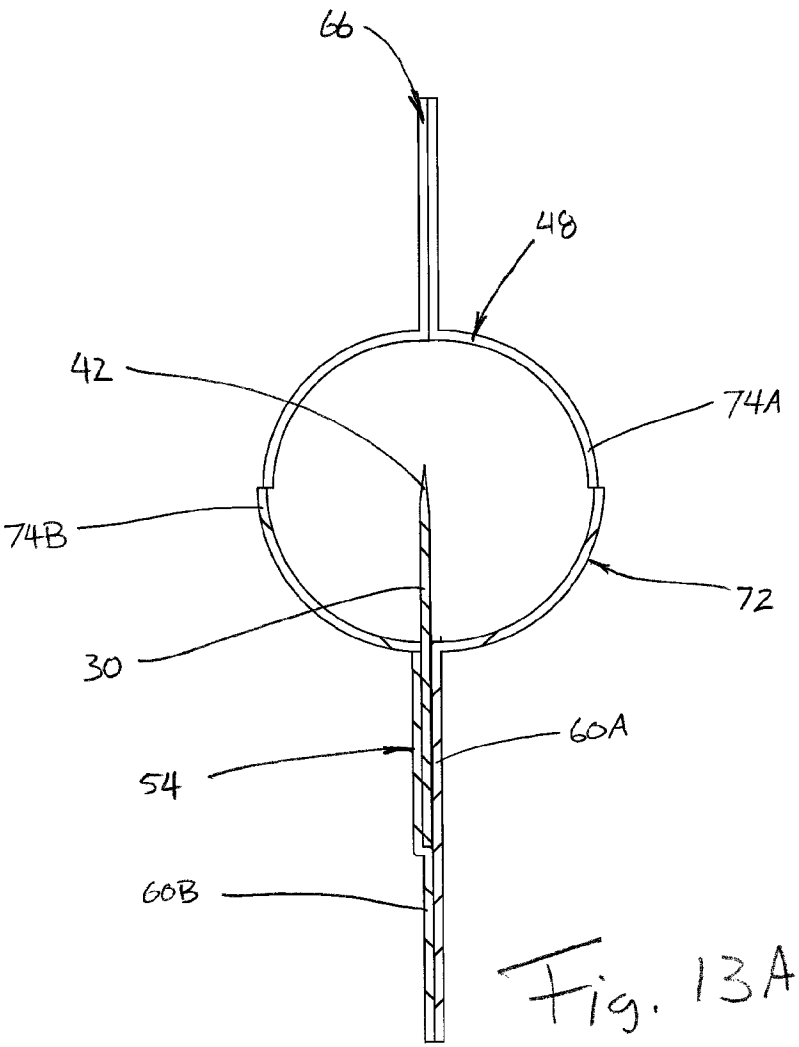
FIG. 13A is a cross-sectional view taken along line A-A of FIG. 13.
Figure 13B:
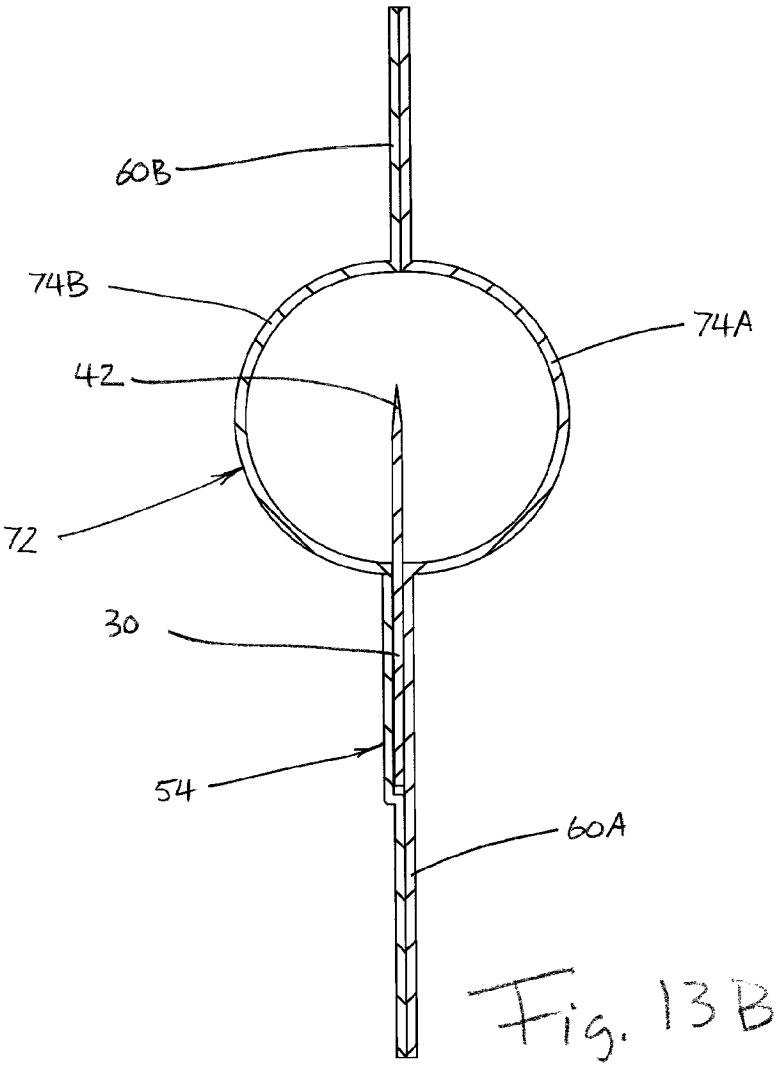
FIG. 13B is a cross-sectional view taken along line B-B of FIG. 13.
Figure 13C:
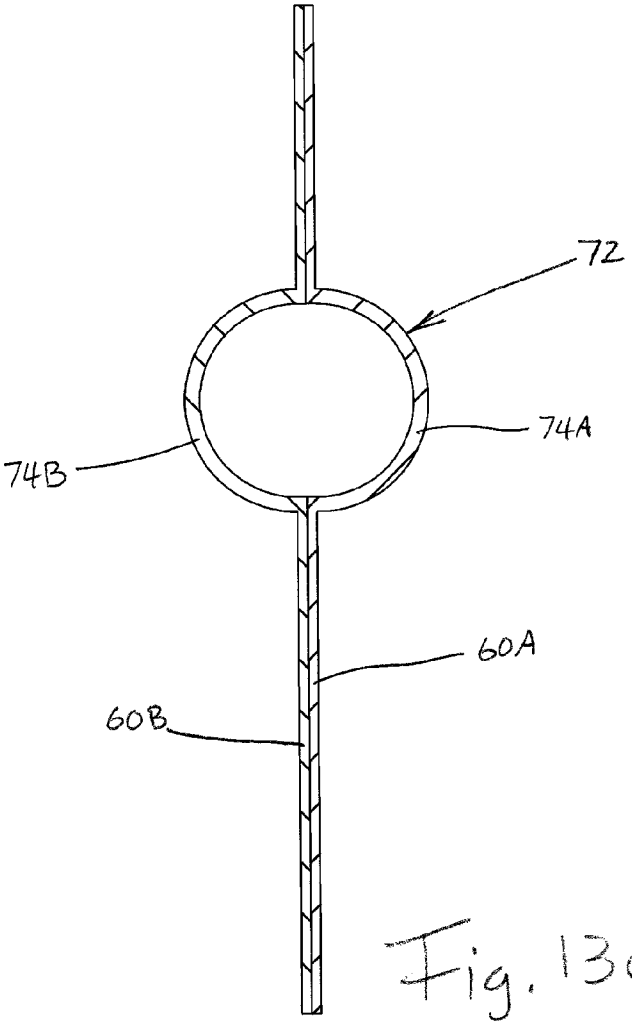
FIG. 13C is a cross-sectional view taken along line C-C of FIG. 13.
Figure 13D:
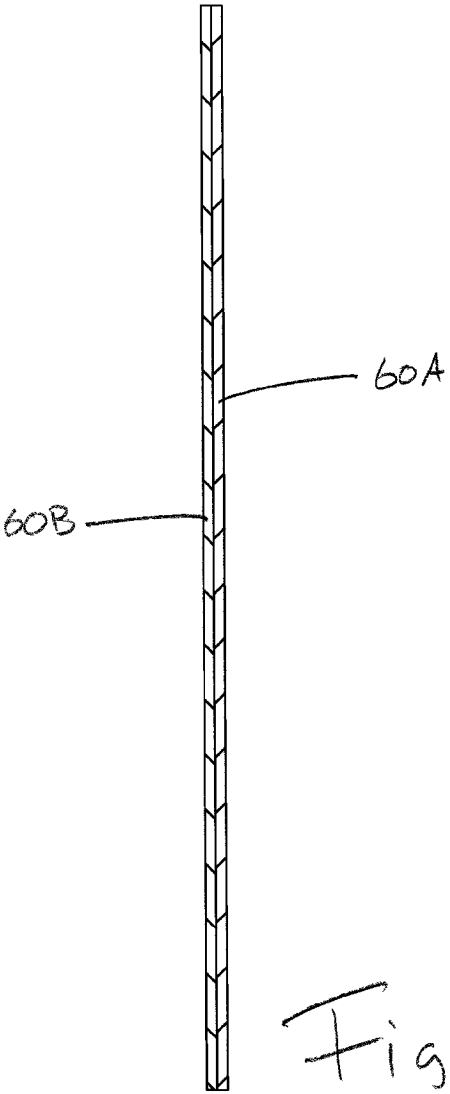
FIG. 13D is a cross-sectional view taken along line D-D of FIG. 13.

A pocket 54 can be formed in one or both appendages 60A, 60B as shown in FIGS. 12 and 13 corresponding to and adapted to receive the cutting blade 30. Similar to the embodiment of FIGS. 1-7, pocket 54 here similarly accommodates the thickness of blade 30. During assembly and the bonding of spool halves 12, 14 and the appendages 60A, 60B, blade 30 is located in pocket 54 and is sandwiched and thermally bonded between the appendages 60A, 60B. Accordingly, after assembly, blade 30 is generally parallel with the appendages 60A, 60B and is securely retained with its cutting edge 42 generally perpendicular to the monofilament line receiving slot 48.

Although not necessary for the operation and use of the monofilament line cutting tool 18, preferably, as shown in the embodiment of FIGS. 8-13, a sphere 72 or other equivalent three-dimensional shapes can be formed generally around the blade cutting edge 42 for preventing unobstructed access thereto. More particularly, each of the appendages 60A, 60B can be thermally shaped and formed to include half sphere projections 74A, 74B. When appendages 60A, 60B are bonded to one another, half sphere projections are located adjacent one another thereby forming a sphere 72 generally around the blade cutting edge 42. The slots 62A, 62*b* are cut to extend into the respective half sphere projections 74A, 74B and, hence, the formed monofilament line receiving slot 48 extends into the sphere 72 and to the cutting blade edge 42.

In operation and use of the embodiment shown in FIGS. 8-13, monofilament line 24 from spool 22 or another source can be cut by bending into a U-shape 56 and inserting through the cutting tool slot opening 66 and into the receiving slot 48 whereat it contacts the blade cutting edge 42, while the sphere 72 obstructs other access to the blade cutting edge 42.

Figure 14:
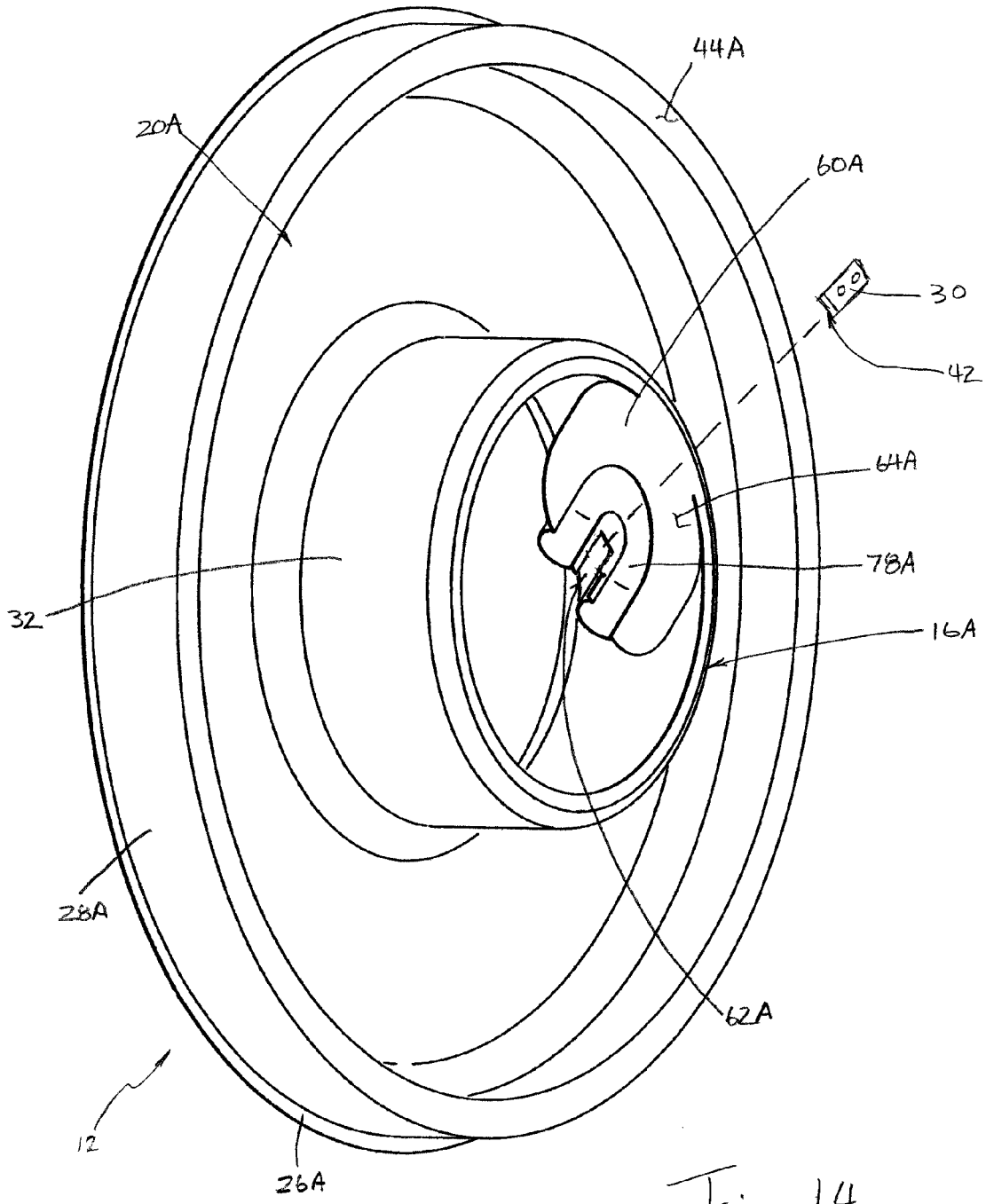
FIG. 14 is a perspective view of a half section of another embodiment of a cutting tool and spool.
Figure 15:
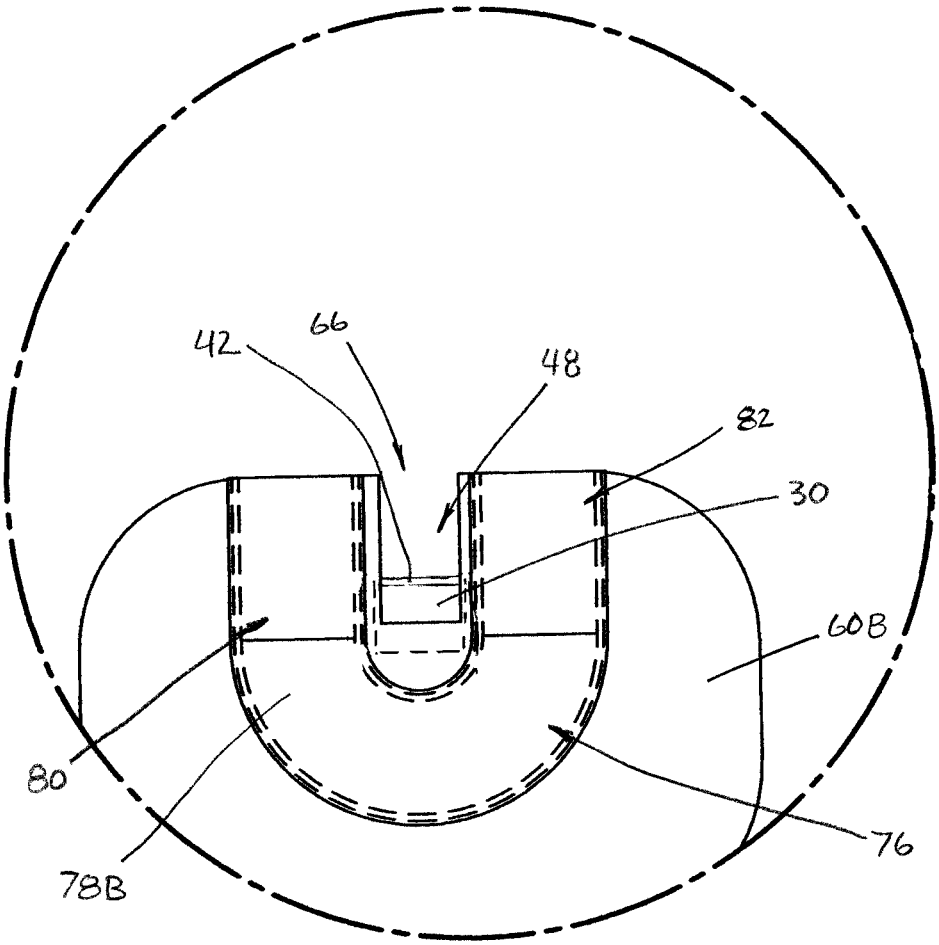
FIG. 15 is an enlarged side elevation view of the center area of the spool shown in FIG. 14 and showing the cutting tool.
Figure 16:
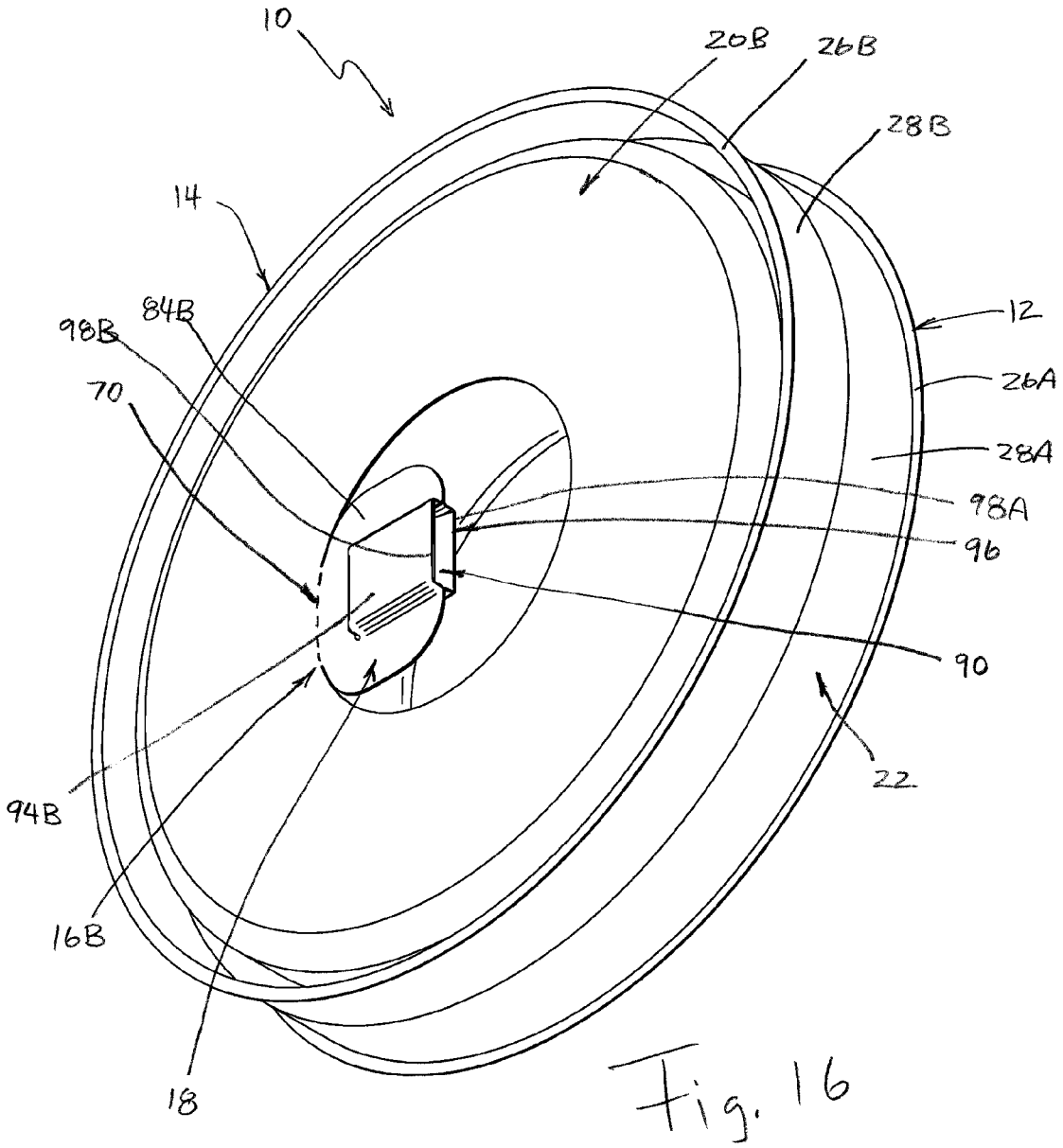
FIG. 16 is a perspective view of another embodiment of a monofilament line cutting tool constructed in accordance with the principles of the present invention and incorporated in a monofilament line retaining spool.
Figure 17:
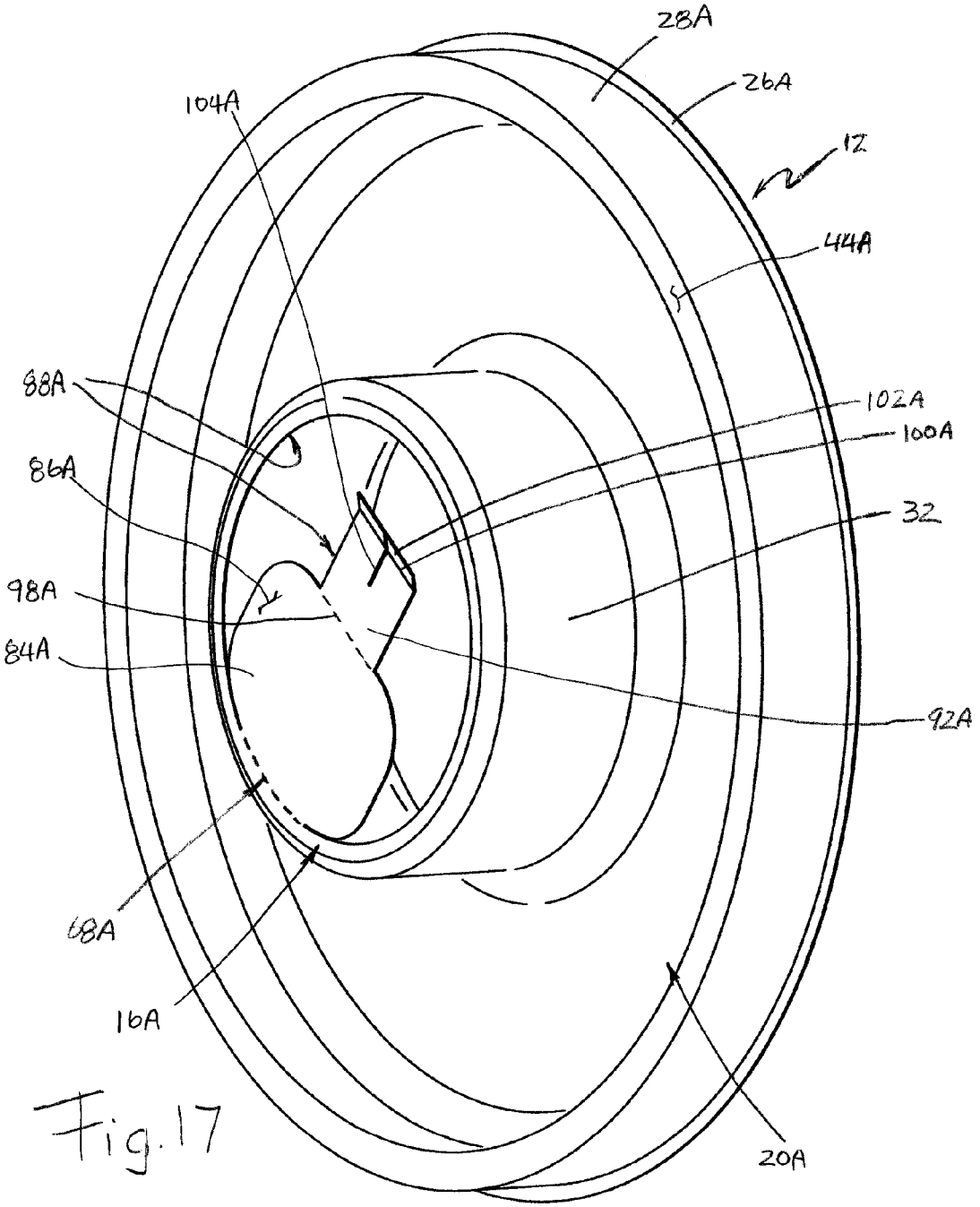
FIG. 17 is a perspective view of one half section of the cutting tool and spool shown in FIG. 16 with the flap unfolded.
Figure 18:
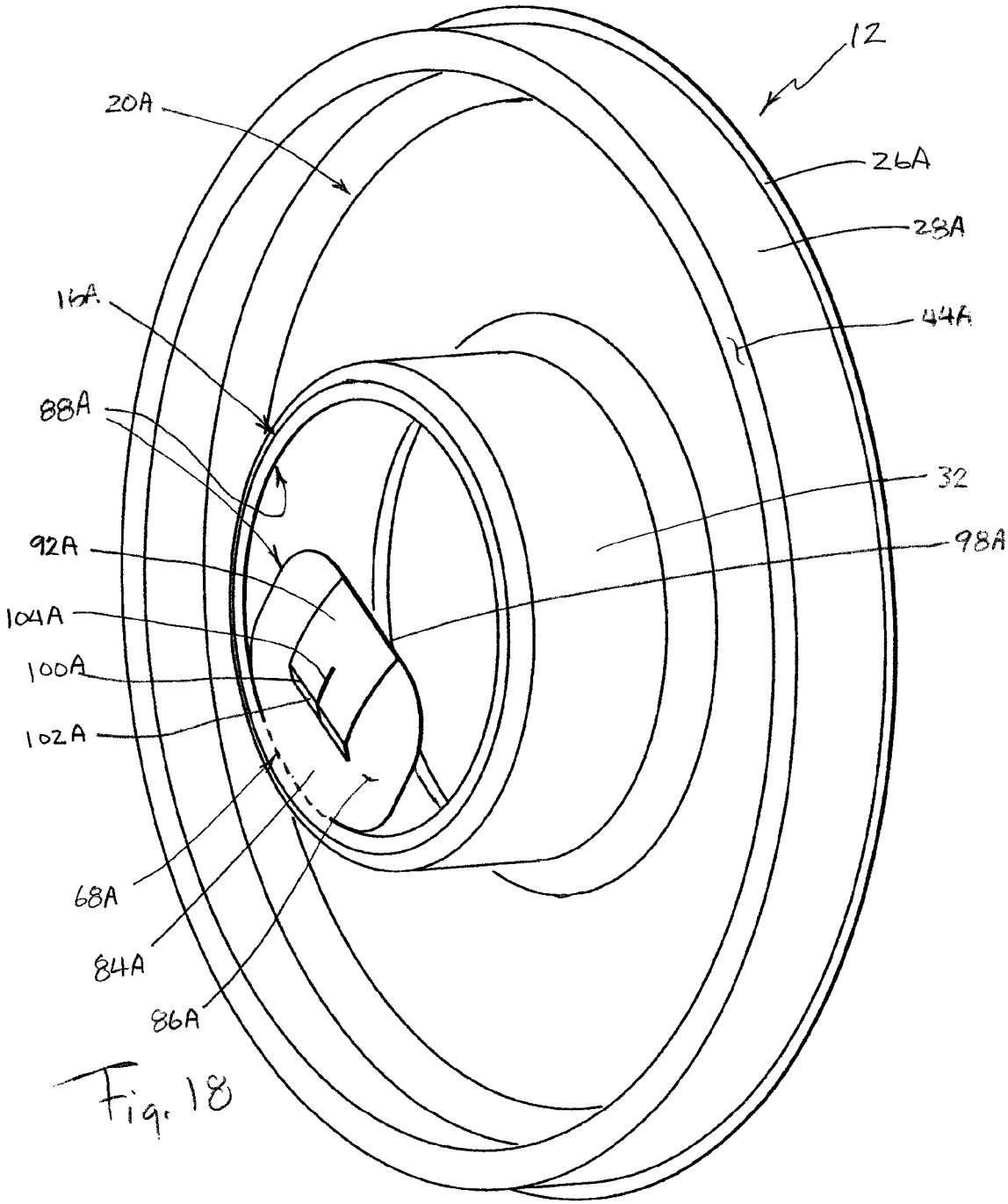
FIG. 18 is a perspective view similar to FIG. 17 with the flap folded.
Figure 19:
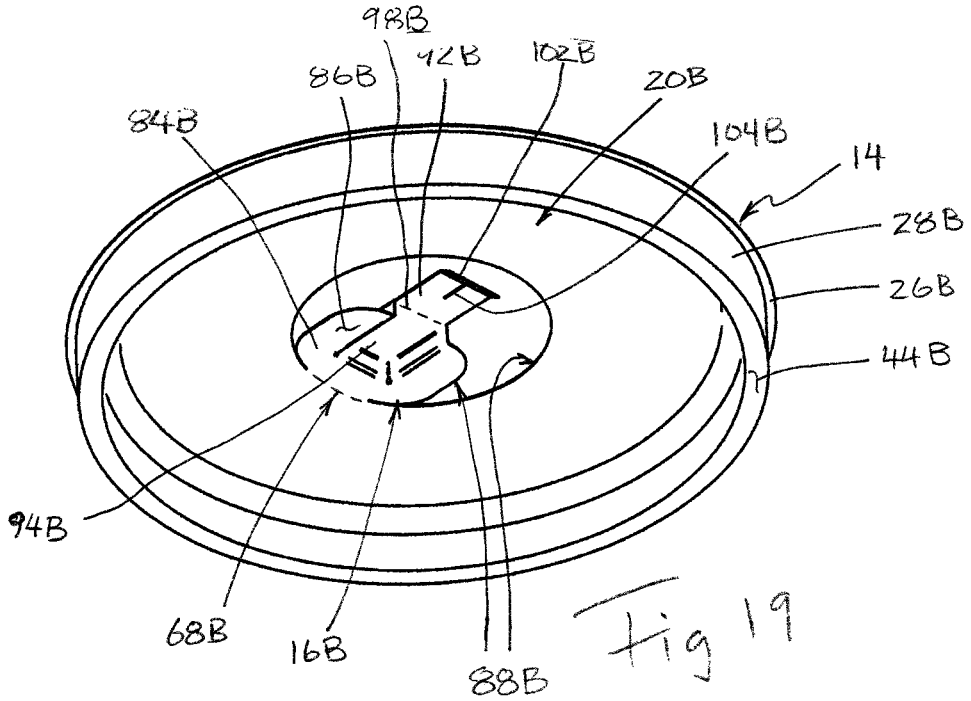
FIG. 19 is a perspective view of the other half section of the cutting tool and spool shown in FIG. 16 with the flap unfolded.
Figure 20:
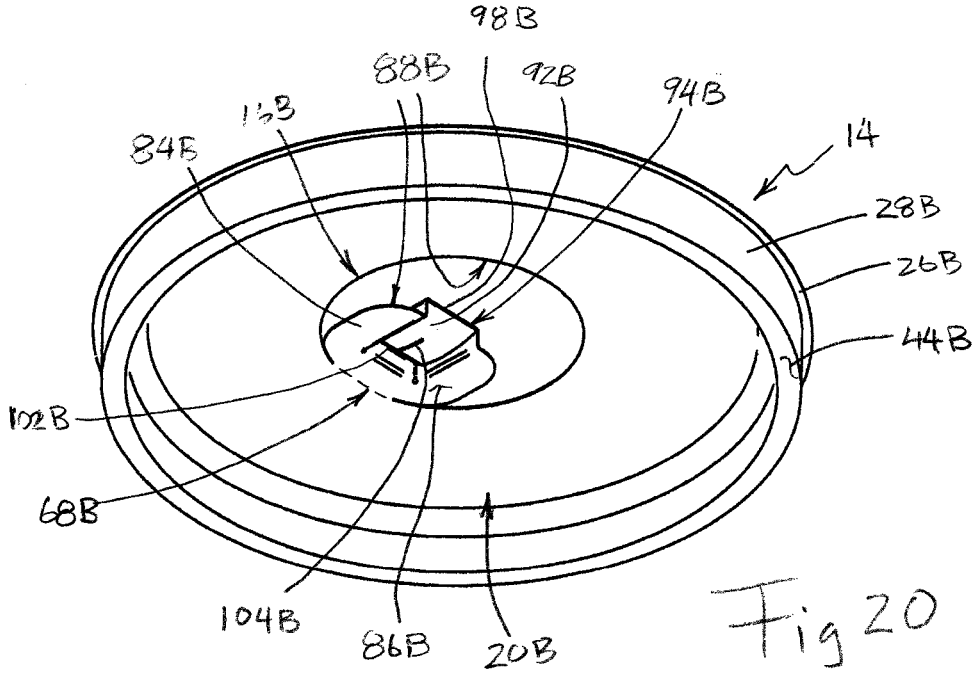
FIG. 20 is a perspective view similar to FIG. 19 with the flap folded.
Figure 21:
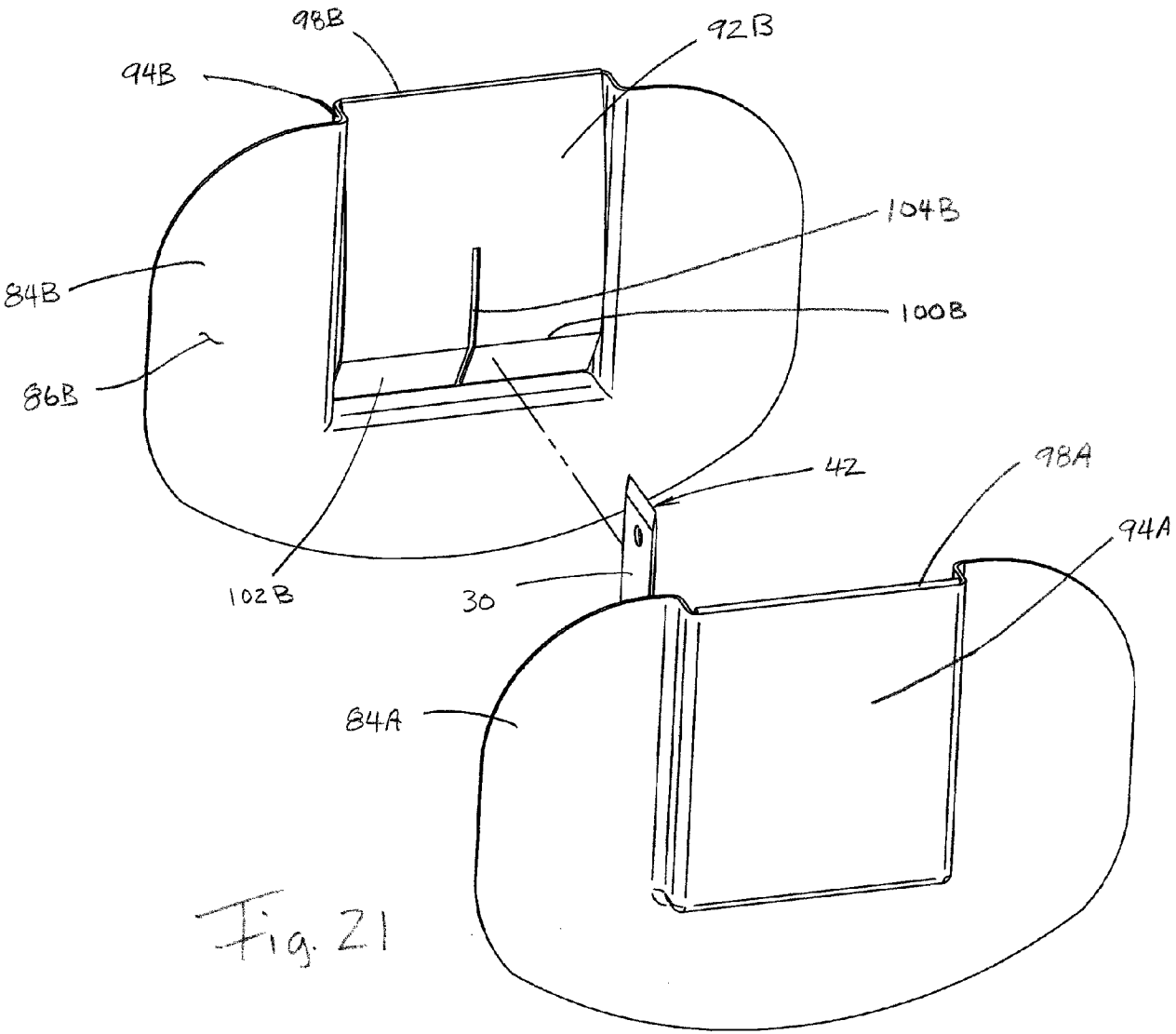
FIG. 21 is an enlarged perspective exploded view of the center area of the spool shown in FIG. 16 and a cutting blade.
Figure 22:
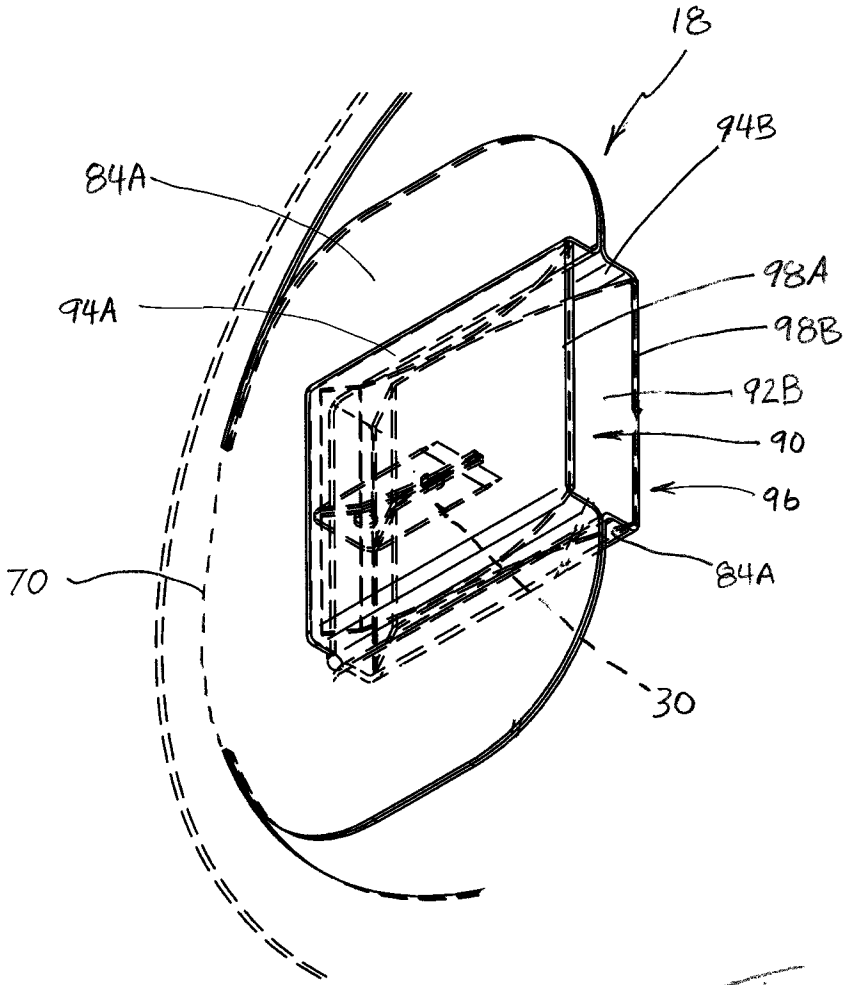
FIG. 22 is an enlarged perspective view of the center area of the spool shown in FIG. 16 and showing the cutting tool with the flaps and cutting blade in dash lines.
Figure 23:
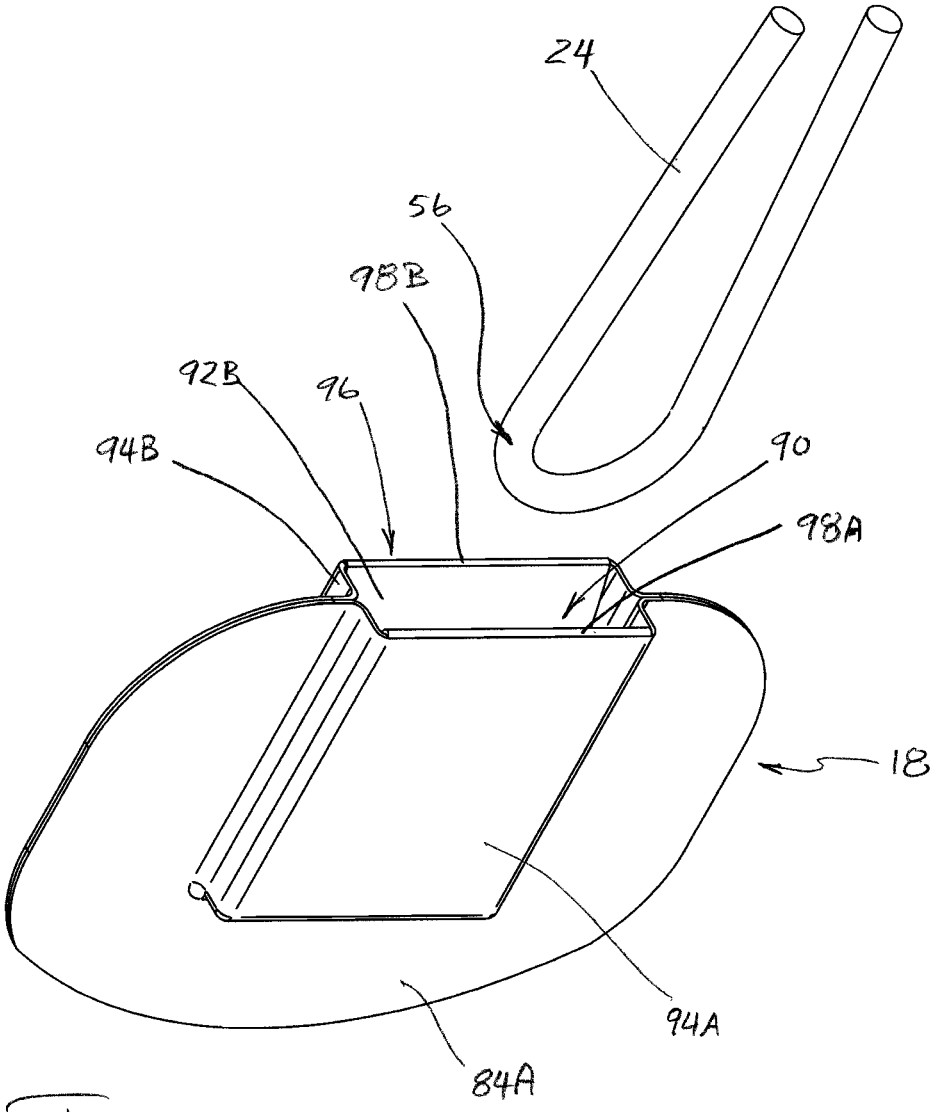
FIG. 23 is an enlarged perspective view of the center area of the spool shown in FIG. 16 and showing the cutting tool.
Figure 24:
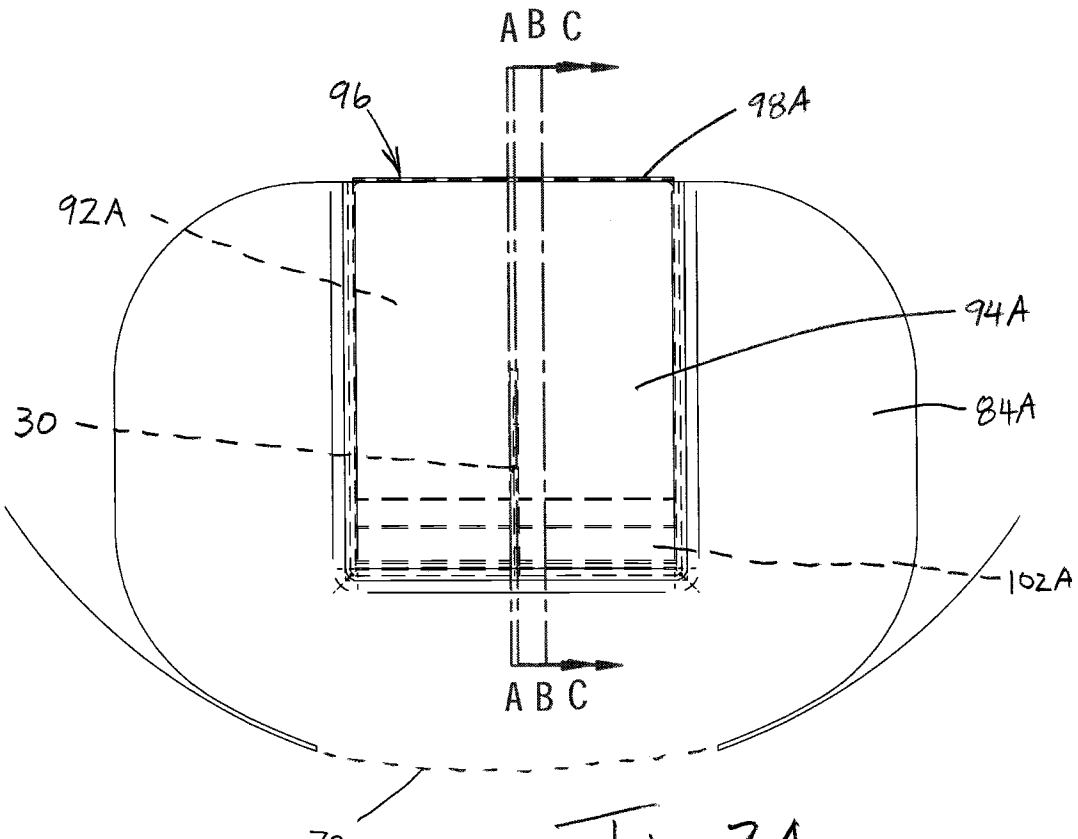
FIG. 24 is an enlarged side elevation view of the center area of the spool shown in FIG. 16 and showing the cutting tool.
Figure 24A:
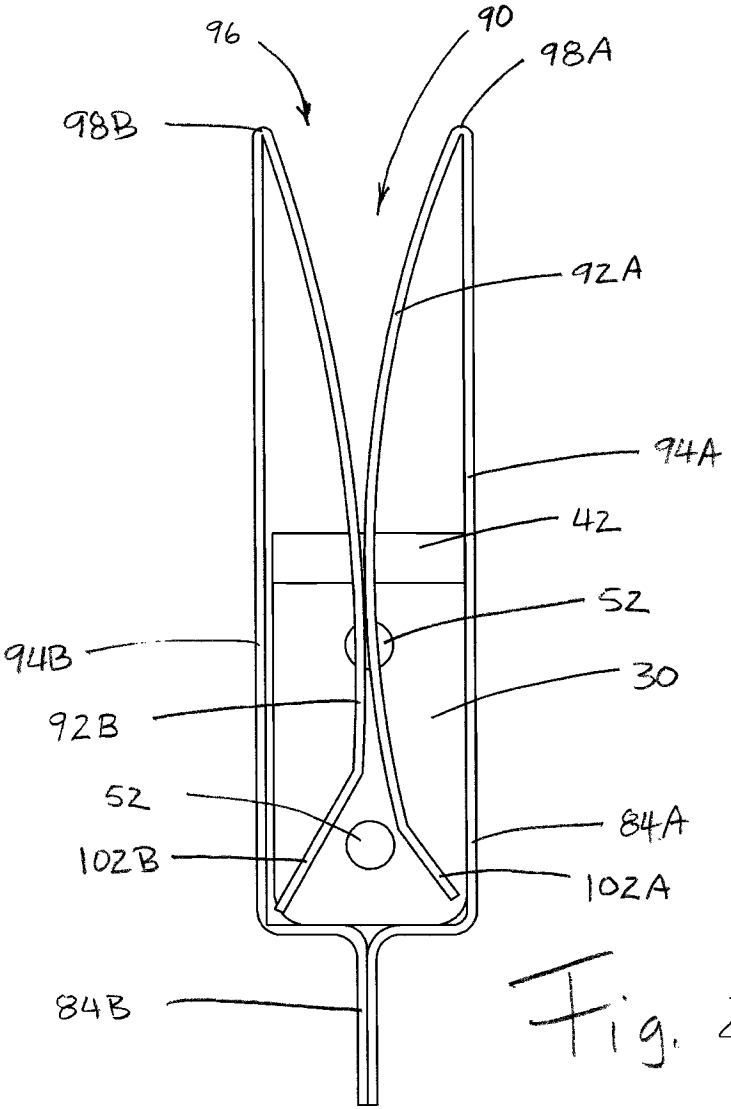
FIG. 24A is a cross-sectional view taken along line A-A of FIG. 24.
Figure 24B:
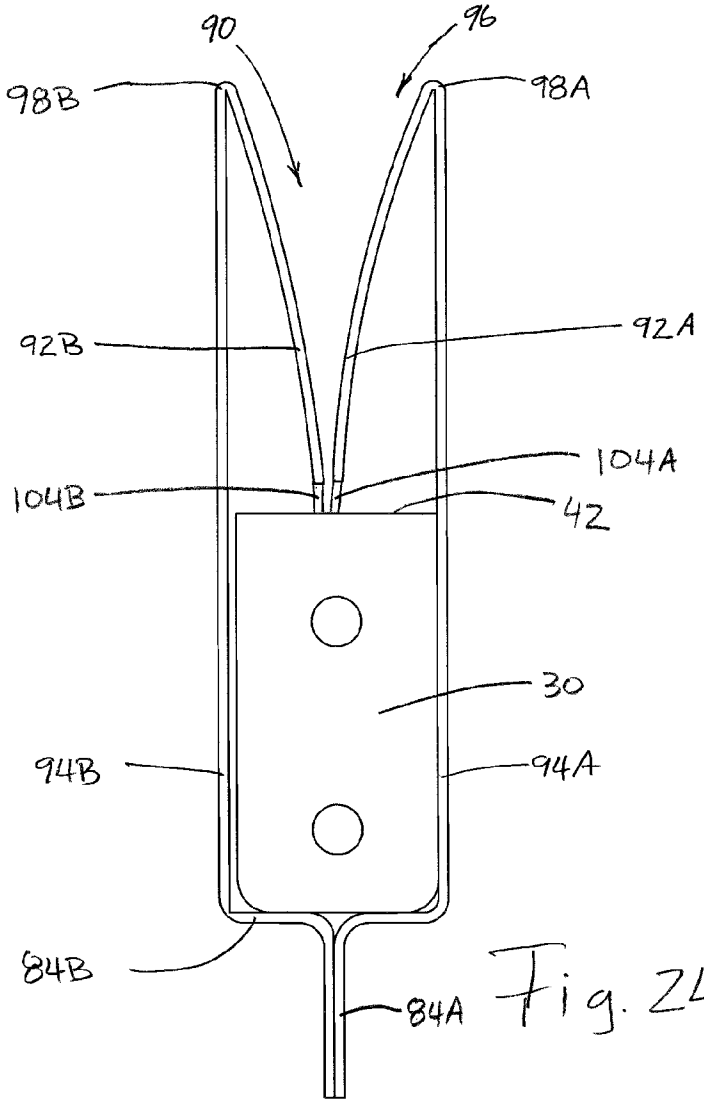
FIG. 24B is a cross-sectional view taken along line B-B of FIG. 24; and, FIG. 24C is a cross-sectional view taken along line C-C of FIG. 24.
Figure 24C:
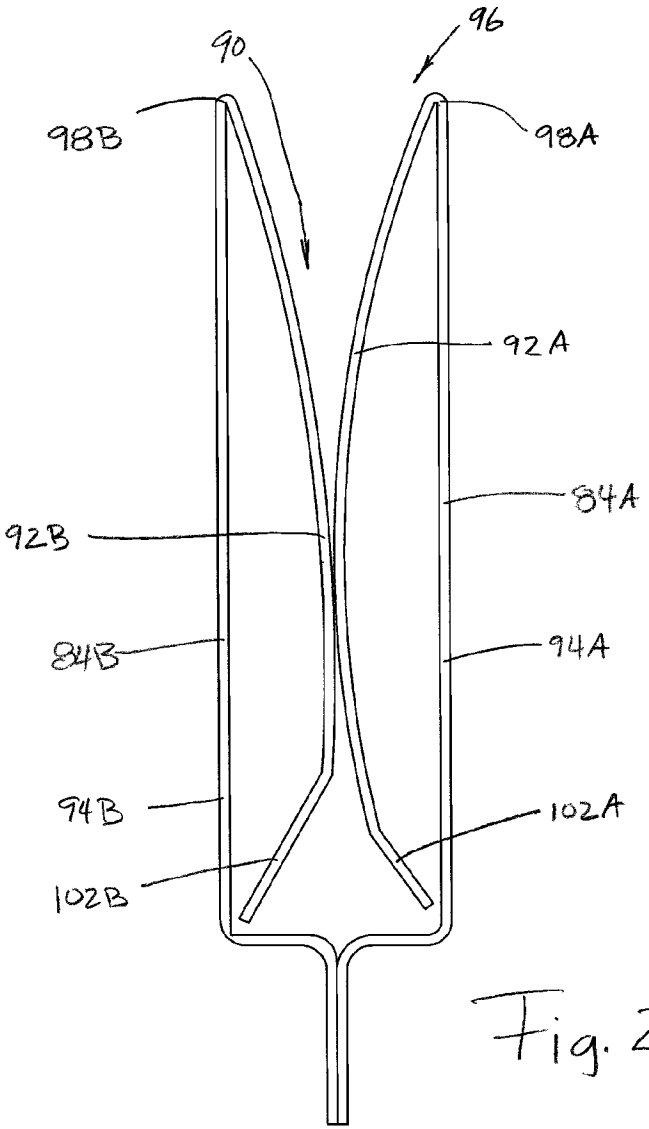

An example of another three-dimensional shape that can be formed generally around the blade cutting edge 42 for preventing unobstructed access thereto is shown in FIGS. 14 and 15. Here, the three dimensional shape is in the form of a U-shaped cylinder 76. U-shaped projections 78A, 78B are thermally shaped and formed in the respective appendages 60A, 60B. Projections 78A, 78B are mirror images of one another and, when appendages 60A, 60B are bonded to one another, the projections 78A, 78B are located adjacent one another thereby forming the U-shaped cylinder 76. The legs of the U-shaped cylinder thus form a pair of parallel barrels 80, 82 extending on either side of the slot 48 and parallel thereto.

During assembly and the bonding of spool halves 12, 14 and the appendages 60A, 60B, blade 30 is located between the parallel barrels 80, 82 and is sandwiched and thermally bonded between the appendages 60A, 60B. Accordingly, after assembly, blade 30 is generally parallel with the appendages 60A, 60B and is securely retained therebetween. The blade cutting edge 42 is generally perpendicular to the monofilament line receiving slot 48 which extends from the slot opening 66 to the blade cutting edge 42. Blade cutting edge 42, thus, also extends generally perpendicular to and between the cylindrical barrels 80, 82.

The embodiment of FIGS. 16-24 is also substantially similar to the above described embodiments. The spool halves 12, 14 are similarly joined to form a spool 22 by thermally bonding their respective annular surfaces 44A, 44B to one another. Appendages 84A, 84B include appendage surfaces 86A, 86B which are similarly bonded to one another sandwiching and retaining the cutting blade 30 therebetween. Score lines 68A, 68B are aligned with one another and form a live hinge 70 between the monofilament line cutting tool 18 and the spool 22. In the embodiment of FIGS. 16-24, however, the central plastic sheet portions 16A, 16B are cut along pattern lines 88A, 88B for forming the appendages 84A, 84B which, as more fully described hereinbelow, are shaped to form a slot in the form of monofilament line receiving cavity 90 and integral flaps 92A, 92B extending therein.

Rectangular or other equivalent shaped projections 94A, 94B are thermally shaped and formed in the respective appendages 84A, 84B. Projections 94A, 94B are mirror images of one another and, when appendages 84A, 84B are bonded to one another, the projections 94A, 94B are located adjacent one another thereby forming a cavity opening 96 and the monofilament line receiving cavity 90 extending to the blade cutting edge 42. That is, the plastic sheet portions 16A, 16B are shaped so as to be separated from one another for thereby forming the cavity opening 96 and cavity 90 extending to the blade cutting edge 42. Projections 94A, 94B can be provided as mirror images of one another in both appendages 84A, 84B as shown in FIGS. 16 and 21-24. Alternatively, a single projection 94A, 94B can be provided in only one of the respective appendages 84A, 84B while maintaining the other of the two appendages flat as, for example, shown in FIGS. 17-20.

During assembly and the bonding of spool halves 12, 14 and the appendages 84A, 84B, blade 30 is located generally perpendicular between the plastic sheet projections 94A, 94B and is sandwiched and thermally bonded therebetween along with the appendages 84A, 84B. Accordingly, after assembly, blade 30 is located generally perpendicular to the plastic sheet projections 94A, 94B and appendages 84A 84B as shown, and is securely retained therebetween within the cavity 90. The blade cutting edge 42 is, hence, generally perpendicular to the monofilament line receiving cavity 90 which extends from the cavity opening 96 to the blade cutting edge 42. Blade cutting edge 42 also extends generally perpendicular to and between the plastic sheets forming the appendages 84A, 84B and projections 94A, 94B.

As best depicted in FIGS. 17-20, flaps 92A, 92B are cut from the respective central sheet portions 16A, 16B and are integrally formed therewith. Flaps 92A, 92B are bent along respective hinge/bend lines 98A, 98B and thus extend into the cavity 90. The terminal ends of the flaps 92A, 92B are bent along a bend/spring line 100A, 100B with the bent terminal ends 102A, 102B thereof turned back toward and bearing against their respective appendage 84A, 84B or projection 94A, 94B. The bent terminal ends 102A, 102B thereby form a spring whereby their respective flaps 92A, 92B are biased away from their respective appendage 84A, 84B or projection 94A, 94B and into the cavity 90. Bent terminal ends 102A, 102B hence maintain flaps in a normally closed position obstructing access from the cavity opening 96 to the blade cutting edge 42. Alternatively and/or additionally, hinge/bend lines 98A, 98B can be thermally formed, as is known to those skilled in the art, whereby flaps 92A, 92B are not folded back 180° against their respective appendage 84A, 84B or projection 94A, 94B but, rather, away therefrom and into the cavity 90 for maintaining the flaps 92A, 92B in their normally closed positions.

Flap blade receiving slots 104A, 104B are provided in the respective bent terminal ends 102A, 102B and, as best seen in FIGS. 21-24, blade 30 extends therethrough with a part of the terminal ends 102A, 102B being located on opposite sides of the blade. Accordingly, the terminal ends 102A, 102B extend into the cavity 90 beyond the blade cutting edge 42 for more effectively obstructing access from the cavity opening 96 to the blade cutting edge 42. It is noted that because terminal ends 102A, 102B are at an angle from their respective flaps 92A, 92B; a part of the terminal ends 102A, 102B are located on either side of the blade 30; and the planar blade 30 is located generally perpendicular to the axes of flap hinges 98A, 98B, blade 30 can effectively be retained within the cavity 90, if needed or desired, only with the flaps 92A, 92B and without thermally securing the blade 30 directly to the appendages 84A, 84B or projections 94A, 94B.

In operation and use of the embodiment shown in FIGS. 16-24, monofilament line 24 from spool 22 or another source can be cut by bending into a U-shape 56 and inserting the U-shape through the cutting tool cavity opening 96 and into the cavity 90. The leading U-shape 56 of the monofilament line 24 is slidingly pushed against the flaps 92A, 92B so as to overcome the spring biasing forces of the bent terminal ends 102A, 102B and/or the hinge/bend lines 98A, 98B and causing the flaps 92A, 92B to pivot/bend about their hinge axes 98A, 98B toward their respective appendages 84A, 84B or projections 94A, 94B and, hence, toward their open positions. The U-shape 56 may, thus, contact the blade cutting edge 42 for cutting the monofilament line 24.

While this invention has been described as having an exemplary design, the present invention may be further modified within the spirit and scope of this disclosure. This application is therefore intended to cover any variations, uses, or adaptations of the invention using its general principles.

What is claimed is:

1. A monofilament line cutting tool comprising:

a cutting blade having a cutting edge;

a first portion including a first face sheet on one side of a first bend line and a first blade sheet on the other side of said first bend line, said first face sheet being at an angle relative to said first blade sheet;

a first slot extending through said first face sheet, said first blade sheet and said first bend line;

a second portion including a second face sheet on one side of a second bend line and a second blade sheet on the other side of said second bend line, said second face sheet being at an angle relative to said second blade sheet;

a second slot extending through said second face sheet, said second blade sheet and said second bend line;

wherein said first blade sheet is joined with said second blade sheet with said cutting blade sandwiched and retained therebetween; and, wherein said first slot in said first face sheet is aligned with said second slot in said second face sheet and together define a monofilament line opening and wherein said first slot in said first blade sheet is aligned with said second slot in said second blade sheet and together define a monofilament line receiving slot extending from said opening to said blade cutting edge, whereby a monofilament line can be cut by bending into a U-shape and inserting the U-shape through the opening and into the monofilament line receiving slot and contacting said blade cutting edge.

2. The monofilament line cutting tool of claim 1 wherein said first and second portions are made of plastic sheets.

3. The monofilament line cutting tool of claim 2 wherein said respective face and blade sheets are thermally shaped forming their respective bend lines therebetween.

4. The monofilament line cutting tool of claim 1 further wherein said first and second portions are made of plastic sheets and are each part of respective first and second spool forming plastic sheet portions, wherein each said first and second spool forming plastic sheet portions include a cylindrical spool bottom section circumscribing its respective first or second portion, and wherein said cylindrical spool bottom sections are joined to one another forming a spool for wrapping the monofilament line thereon.

5. The monofilament line cutting tool of claim 4 wherein each said first and second spool forming plastic sheet portions include annular walls extending radially from its cylindrical spool bottom section whereby the monofilament line can be wrapped on said spool between said annular walls.

6. The monofilament line cutting tool of claim 1 wherein said first and second portions are made of plastic sheets and wherein said respective face and blade sheets are thermally shaped forming their respective bend lines therebetween and wherein said first and second blade sheets are bonded to one another by thermal welding.

7. The monofilament line cutting tool of claim 1 wherein said first and second portions are made of plastic sheets wherein said first and second blade sheets are bonded by thermal welding.

8. The monofilament line cutting tool of claim 1 wherein said cutting blade is planar shaped and said cutting blade and said first and second blade sheets are in planes parallel to one another.

9. The monofilament line cutting tool of claim 8 further wherein said first and second portions are made of plastic sheets and are each part of respective first and second spool forming plastic sheet portions, wherein each said first and second spool forming plastic sheet portions include a cylindrical spool bottom section circumscribing its respective first or second portion, and wherein said cylindrical spool bottom sections are joined to one another forming a spool for wrapping the monofilament line thereon.

10. The monofilament line cutting tool of claim 9 wherein said first and second portion are thermally shaped forming their respective bend lines between the face and blade sheets and wherein said first and second blade sheets are bonded to one another by thermal welding.

11. The monofilament line cutting tool of claim 8 wherein a pocket is formed into one of said first and second blade sheets adjacent said monofilament line receiving slot wherein said cutting blade is received.

12. The monofilament line cutting tool of claim 1 wherein a pocket is formed into one of said first and second blade sheets adjacent said monofilament line receiving slot wherein said cutting blade is received.

13. The monofilament line cutting tool of claim 1 wherein said first face sheet is parallel to said second face sheet and said first blade sheet is parallel to said second blade sheet.

14. The monofilament line cutting tool of claim 13 wherein said first face sheet is perpendicular to said first blade sheet and said second face sheet is perpendicular to said second blade sheet.

15. The monofilament line cutting tool of claim 14 wherein said cutting blade is planar shaped and said cutting blade is parallel to said first and second blade sheets.

16. The monofilament line cutting tool of claim 15 further wherein said first and second portions are made of plastic sheets and are each part of respective first and second spool forming plastic sheet portions, wherein each said first and second spool forming plastic sheet portions include a cylindrical spool bottom section circumscribing its respective first or second portion, and wherein said cylindrical spool bottom sections are joined to one another forming a spool for wrapping the monofilament line thereon.

17. The monofilament line cutting tool of claim 16 wherein said first and second portions are thermally shaped forming their respective bend lines between the face and blade sheets and wherein said first and second blade sheets are bonded to one another by thermal welding.

18. The monofilament line cutting tool of claim 17 wherein a pocket is formed into one of said first and second blade sheets adjacent said monofilament line receiving slot wherein said cutting blade is received.

19. The monofilament line cutting tool of claim 18 wherein each said first and second spool forming plastic sheet portions include annular walls extending radially from its cylindrical spool bottom section whereby the monofilament line can be wrapped on said spool between said annular walls.

20. The monofilament line cutting tool of claim 13 wherein said cutting blade is planar shaped and said cutting blade is parallel to said first and second blade sheets.

21. The monofilament line cutting tool of claim 20 further wherein said first and second portions are made of plastic sheets and are each part of respective first and second spool forming plastic sheet portions, wherein each said first and second spool forming plastic sheet portions include a cylindrical spool bottom section circumscribing its respective first or second portion, and wherein said cylindrical spool bottom sections are joined to one another forming a spool for wrapping the monofilament line thereon.

22. The monofilament line cutting tool of claim 21 wherein said first and second portions are thermally shaped forming their respective bend lines between the face and blade sheets and wherein said first and second blade sheets are bonded to one another by thermal welding.

23. The monofilament line cutting tool of claim 22 wherein a pocket is formed into ne of said first and second blade sheets adjacent said monofilament line receiving slot wherein said cutting blade is received.

24. The monofilament line cutting tool of claim 23 wherein each said first and second spool forming plastic sheet portions include annular walls extending radially from its cylindrical spool bottom section whereby the monofilament line can be wrapped on said spool between said annular walls.

25. The monofilament line cutting tool of claim 1 wherein said first bend line is parallel with said second bend line.

26. The monofilament line cutting tool of claim 25 wherein said cutting blade is planar shaped and said cutting blade parallel with said first and second blade sheets.

27. The monofilament line cutting tool of claim 26 further wherein said first and second portions are made of plastic sheets and are each part of respective first and second spool forming plastic sheet portions, wherein each said first and second spool forming plastic sheet portions include a cylindrical spool bottom section circumscribing its respective first or second portion, and wherein said cylindrical spool bottom sections are joined to one another forming a spool for wrapping the monofilament line thereon.

28. The monofilament line cutting tool of claim 27 wherein said first and second portions are thermally shaped forming their respective bend lines between the face and blade sheets and wherein said first and second blade sheets are bonded to one another by thermal welding.

29. The monofilament line cutting tool of claim 28 wherein a pocket is formed into one of said first and second blade sheets adjacent said monofilament line receiving slot wherein said cutting blade is received.

30. The monofilament line cutting tool of claim 29 wherein each said first and second spool forming plastic sheet portions include annular walls extending radially from its cylindrical spool bottom section whereby the monofilament line can be wrapped on said spool between said annular walls.

31. The monofilament line cutting tool of claim 25 wherein said first face sheet is parallel with said second face sheet and said first blade sheet is parallel to said second blade sheet.

32. The monofilament line cutting tool of claim 31 wherein said first face sheet is perpendicular to said first blade sheet and said second face sheet is perpendicular to said second blade sheet.

33. The monofilament line cutting tool of claim 25 wherein said first face sheet is perpendicular to said first blade sheet and said second face sheet is perpendicular to said second blade sheet.

34. The monofilament line cutting tool of claim 1 wherein said first and second face sheets are coplanar, said first bend line is parallel to and adjacent said second bend line, and said first blade sheet is parallel to said second blade sheet.

35. The monofilament line cutting tool of claim 34 wherein said cutting blade is planar shaped and said cutting blade is parallel to said first and second blade sheets.

36. The monofilament line cutting tool of claim 35 further wherein said first and second portions are made of plastic sheets and are each part of respective first and second spool forming plastic sheet portions, wherein each said first and second spool forming plastic sheet portions include a cylindrical spool bottom section circumscribing its respective first or second portion, and wherein said cylindrical spool bottom sections are joined to one another forming a spool for wrapping the monofilament line thereon.

37. The monofilament line cutting tool of claim 36 wherein said first and second portions are thermally shaped forming their respective bend lines between the face and blade sheets and wherein said first and second blade sheets arc bonded to one another by thermal welding.

38. The monofilament line cutting tool of claim 37 wherein a pocket is formed into one of said first and second blade sheets adjacent said monofilament line receiving slot wherein said cutting blade is received.

39. The monofilament line cutting tool of claim 38 wherein each said first and second spool forming plastic sheet portions include annular walls extending radially from its cylindrical spool bottom section whereby the monofilament line can be wrapped on said spool between said annular walls.

* * * * *

UNITED STATES PATENT AND TRADEMARK OFFICE

CERTIFICATE OF CORRECTION

PATENT NO. : 9,032,629 B2
APPLICATION NO. : 13/430815
DATED : May 19, 2015
INVENTOR(S) : Steven P. Bermes et al.

It is certified that error appears in the above-identified patent and that said Letters Patent is hereby corrected as shown below:

In the Claims

Col. 11, Claim 31, line 22, change "with" to --to--

Signed and Sealed this
Twenty-second Day of September, 2015

Michelle K. Lee

Michelle K. Lee
*Director of the United States Patent and Trademark Office*